US008521063B2

(12) United States Patent
Saito et al.

(10) Patent No.: US 8,521,063 B2
(45) Date of Patent: Aug. 27, 2013

(54) IMAGE FORMING APPARATUS HAVING A ROTARY BODY THAT INCLUDES SHAFT PORTIONS FITTED INTO POSITIONING GROOVES

(75) Inventors: Yasuhide Saito, Kanagawa (JP); Ryotaro Nomi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 413 days.

(21) Appl. No.: 12/905,705

(22) Filed: Oct. 15, 2010

(65) Prior Publication Data

US 2011/0236059 A1 Sep. 29, 2011

(30) Foreign Application Priority Data

Mar. 26, 2010 (JP) ..... 2010-073724

(51) Int. Cl.
*G03G 15/08* (2006.01)
*G03G 21/00* (2006.01)

(52) U.S. Cl.
USPC ..... 399/121; 399/124

(58) Field of Classification Search
USPC ..... 399/107, 110, 121, 124
See application file for complete search history.

(56) References Cited

U.S. PATENT DOCUMENTS

| | | | | |
|---|---|---|---|---|
| 2006/0093397 | A1* | 5/2006 | Yamaoka | 399/110 |
| 2007/0091157 | A1* | 4/2007 | Ito | |
| 2007/0092292 | A1* | 4/2007 | Ito | 399/124 |
| 2007/0160383 | A1 | 7/2007 | Matsumoto et al. | |
| 2007/0212108 | A1* | 9/2007 | Hozono et al. | 399/121 |

FOREIGN PATENT DOCUMENTS

| | | | |
|---|---|---|---|
| JP | 10-031405 | A | 2/1998 |
| JP | 2000-330353 | A | 11/2000 |
| JP | 2007-128108 | A | 5/2007 |
| JP | 2007-183426 | A | 7/2007 |

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus includes: a rotary body; a rotary body retaining member; pressure members that press the rotary body retaining member along a direction to bring shaft portions of the rotary body into positioning grooves; and an operation member. When an open/shut cover is in an open position, the operation member comes into contact with the rotary body retaining member so as to press the rotary body retaining member in a direction to bring the shaft portions of the rotary body out of the positioning grooves. When the open/shut cover is swung to a close position, the operation member is contacted by the rotary body retaining member pressed by the pressure members, thereby bringing the operation member into contact with part of the apparatus body and keeping the operation member still. The rotary body retaining member and the operation member touch each other through elastic buffering members.

8 Claims, 16 Drawing Sheets

IMAGE FORMING APPARATUS HAVING A ROTARY BODY THAT INCLUDES SHAFT PORTIONS FITTED INTO POSITIONING GROOVES

CROSS-REFERENCE TO RELATED APPLICATIONS

This application is based on and claims priority under 35 USC 119 from Japanese Patent Application No. 2010-073724 filed on Mar. 26, 2010.

BACKGROUND

1. Technical Field

The present invention relates to an image forming apparatus.

2. Related Art

Some image forming apparatuses for forming an image on a recording medium use a structure in which a rotary body such as a transfer roll is attached to an open/shut door for opening/closing part of an apparatus body.

SUMMARY

According to an aspect of the invention, an image forming apparatus includes: an apparatus body that includes an open portion which opens an inside of the apparatus body to an outside, and an open/shut cover that swings to open/close the open portion; positioning grooves that are provided inside the apparatus body; a rotary body that includes shaft portions that are fitted into the positioning grooves when the open/shut cover is swung to a position to close the open portion; a rotary body retaining member that is attached to an inner side of the open/shut cover so as to be movable along a direction to bring the shaft portions of the rotary body out of the positioning grooves, and that retains the rotary body so that the rotary body can rotate therein; pressure members that press the rotary body retaining member along a direction to bring the shaft portions of the rotary body into the positioning grooves; and an operation member that is attached to the inner side of the open/shut cover so as to be movable along the direction to bring the shaft portions of the rotary body out of the positioning grooves. When the open/shut cover is swung to a position to open the open portion, the operation member comes into contact with the rotary body retaining member so as to press the rotary body retaining member in the direction to bring the shaft portions of the rotary body out of the positioning grooves. When the open/shut cover is swung to a position to close the open portion, the operation member is contacted by the rotary body retaining member pressed by the pressure members, thereby bringing the operation member into contact with part of the apparatus body and keeping the operation member still. The rotary body retaining member and the operation member touch each other through elastic buffering members.

BRIEF DESCRIPTION OF THE DRAWINGS

Exemplary embodiment(s) of the present invention will be described in detail based on the following figures, wherein.

DETAILED DESCRIPTION

An exemplary embodiment of the invention will be described below with reference to the accompanying drawings.

Figure 1:
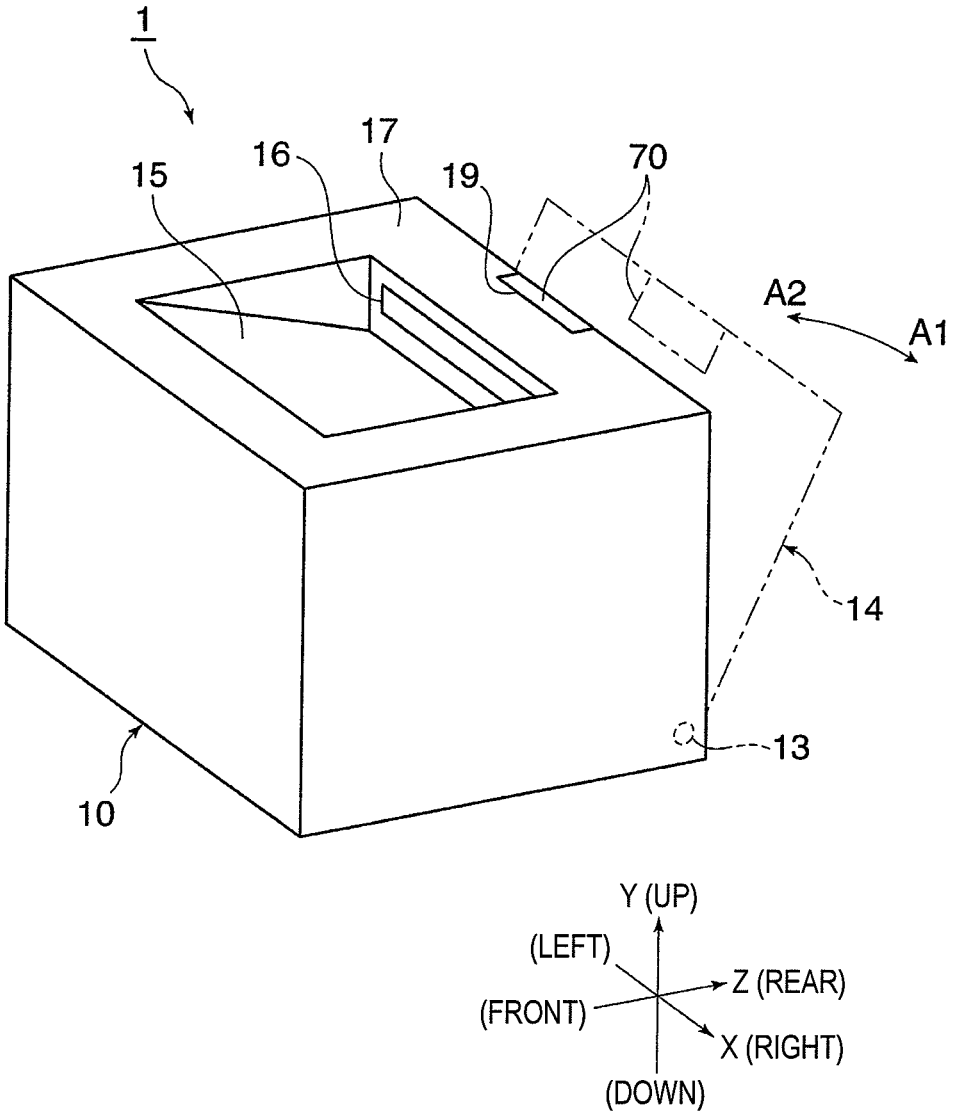
FIG. 1 is a perspective view showing an external appearance of an image forming apparatus according to Embodiment 1 of the invention.
Figure 2:
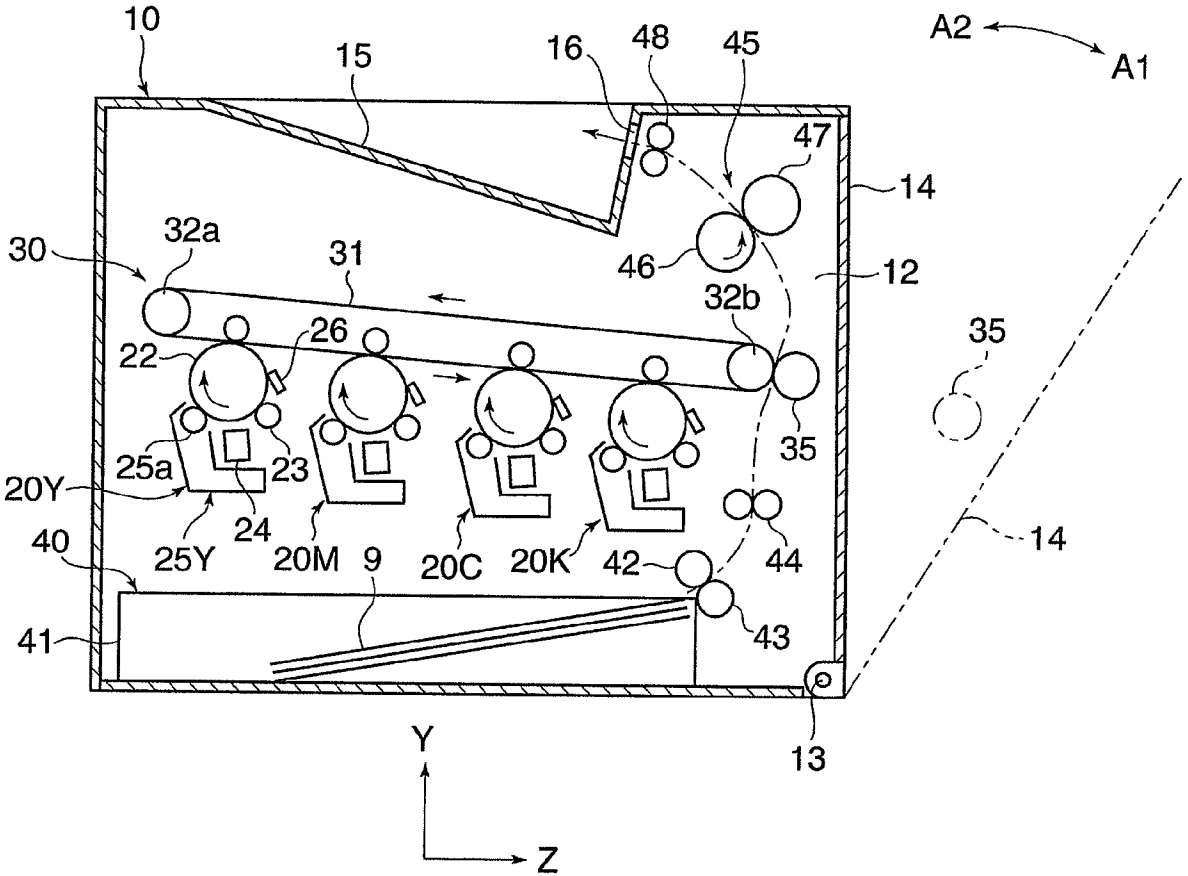
FIG. 2 is a schematic sectional view showing main part of the image forming apparatus in FIG. 1.
Figure 3:
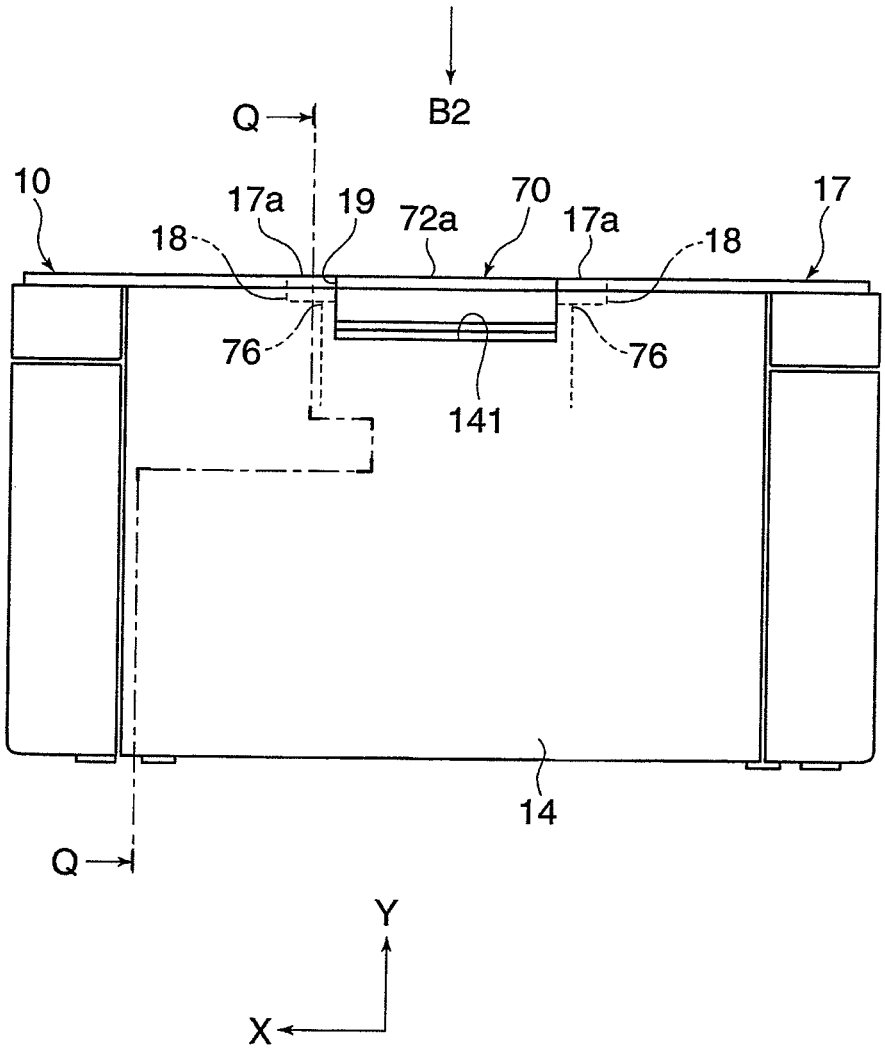
FIG. 3 is a rear view showing a state of a rear side of the image forming apparatus in FIG. 1.

FIGS. 1 to 3 show an image forming apparatus 1 according to Embodiment 1 of the invention. FIG. 1 is a perspective view showing an external appearance of the image forming apparatus 1. FIG. 2 is a schematic sectional view showing main part of the image forming apparatus 1. FIG. 3 is a side view showing the state of the external appearance when seen from one side portion (rear portion in this example) of the image forming apparatus 1. Arrows X, Y, and Z shown in the drawings express coordinate axes. A direction along the coordinate axis X is a "left-right direction" in the image forming apparatus. A direction along the coordinate axis Y is an "up-down direction" in the image forming apparatus. A direction along the coordinate axis Z is a "front-rear direction" in the image forming apparatus.

The image forming apparatus 1 has an apparatus body 10 which is made up of a support member, an exterior member etc. The apparatus body 10 is shaped like a box in external appearance as a whole, so that a required space is formed inside the apparatus body 10. The apparatus body 10 has an open portion 12 (FIG. 5) which is formed in one side portion of the apparatus body 10 so that the inside of the apparatus body 10 is open to the outside. The open portion 12 is covered with a rear cover 14 as an open/shut cover which pivots in directions indicated by arrows A1 and A2 on hinges (shaft) 13 to thereby open/close the open portion 12. The direction indicated by the arrow A1 is a direction of the rear cover 14 to open the open portion 12. The direction indicated by the arrow A2 is a direction of the rear cover 14 to close the open portion 12.

A sheet feeder 40 which stacks and feeds sheets of recording paper 9 as a subject of image formation is disposed in a lower portion of the apparatus body 10. An ejection/stack portion 15 which ejects and stacks sheets of recording paper 9 after image formation is formed in an upper portion of the apparatus body 10. The ejection/stack portion 15 has an ejection port 16 through which each sheet of recording paper 9 is ejected. A chain line with an arrow shown in FIG. 2 indicates a primary conveyance path of the sheet of recording paper 9.

In the sheet feeder 40, after a top one of the sheets of recording paper 9 stacked in a sheet stacker 41 is paid out by a feed roll 42, the feed roll 42 cooperates with a separation roll 43 to separate and feed out the sheets of recording paper 9 one by one. After the sheet 9 sent out thus is suspended temporarily by a conveyance control roll 44, the sheet 9 is conveyed to a position (secondary transfer position) between an intermediate transfer unit 30 and a secondary transfer device 35 at predetermined timing (timing in accordance with a secondary transfer process which will be described later). The intermediate transfer unit 30 will be described later.

Image forming devices 20 as image forming means, the intermediate transfer unit 30, the secondary transfer device 35, a fixing device 45, etc. are disposed inside the apparatus body 10. The image forming devices 20 are constituted by four image forming devices 20Y, 20M, 20C and 20K for forming developing agent (toner) images of four colors, i.e., yellow (Y), magenta (M), cyan (C) and black (K), respectively. The image forming devices 20 (Y, M, C, K) in Embodiment 1 are disposed in such a state (slanting state) that the placed image forming devices 20 are positioned gradually higher in level in order of black, cyan, magenta and yellow.

Each image forming device 20 (Y, M, C, K) includes: a photoconductor drum 22 (Y, M, C, K) as an image holder which rotates in a predetermined direction (indicated by an arrow); a charging device 23 which electrostatically charges a surface of the photoconductor drum 22; an optical writing device 24 as a latent image forming means; a developing device 25 (Y, M, C, K); and a drum cleaning device 26 which removes toner, etc. remaining on the surface of the photoconductor drum 22 after transfer.

A charging device having a charging roll disposed so that a charging bias voltage is applied to the charging roll while the charging roll is brought into contact with the surface of the photoconductor drum 22 is used as the charging device 23. An exposure device having a light source such as a light-emitting diode (LED) or a semiconductor laser, and optical elements such as a lens and a mirror is used as the optical writing device 24. A device for conveying a developing agent (toner) while holding the developing agent (toner) on a developing roll 25*a* rotating in a state where the developing roll 25*a* approaches a development region of the photoconductor drum 22 is used as the developing device 25. A device having an elastic blade disposed to come into contact with the surface of the photoconductor drum 22 for collecting toner, etc. removed by the elastic blade is used as the drum cleaning device 26.

In the image forming devices 20 (Y, M, C, K), images are formed as follows. First, after the surface (photosensitive layer) of each rotating photoconductor drum 22 is charged with predetermined electric potential by a corresponding charging device 23, the thus charged photoconductor drum 22 is exposed to light emitted from a corresponding optical writing device 24 based on image information supplied to the image forming apparatus 1 to thereby form an electrostatic latent image of each color component having the predetermined electric potential. Successively, the electrostatic latent images of the respective color components on the photoconductor drums 22 are developed by corresponding color developing agents supplied from the developing devices 25 to thereby form toner images of the four colors. The toner images on the photoconductor drums 22 are primarily transferred to an intermediate transfer belt 31 of the intermediate transfer unit 30 as will be described later.

The intermediate transfer unit 30 includes: an endless intermediate transfer belt 31 which is provided so that toner images of the respective colors formed on the photoconductor drums 22 of the image forming devices 20 (Y, M, C, K) respectively are transferred onto an outer circumferential surface of the intermediate transfer belt 31; support rolls 32*a* and 32*b* which rotate the intermediate transfer belt 31 laid over the support rolls 32*a* and 32*b* so that the intermediate transfer belt 31 is in contact with the respective photoconductor drums 22; and primary transfer devices by which the toner images on the photoconductor drums 22 are primarily transferred onto the outer circumferential surface of the intermediate transfer belt 31. The support roller 32*b* is a driving roll which receives rotation power transmitted from a rotation driving device not shown and rotates the intermediate transfer belt 31 in a direction indicated by arrows. Primary transfer rolls which are disposed in such a state that the primary transfer rolls come into contact with an inner circumferential surface of the intermediate transfer belt 31 and press an outer circumferential surface of the belt 31 against the respective surfaces of the photoconductor drums 22 and to which a primary transfer bias voltage is applied, are used as the primary transfer devices.

In the intermediate transfer unit 30, toner images are electrostatically primarily transferred from the photoconductor drums 22 of the image forming devices 20 (Y, M, C, K) respectively to the outer circumferential surface of the intermediate transfer belt 31 rotating in the direction indicated as the arrows, by the function of the primary transfer rolls. A toner image primarily transferred in such a manner that toner images of colors are superposed on one another or a toner image of one color (black in this example) is provided is held on the outer circumferential surface of the intermediate transfer belt 31.

The secondary transfer device 35 is provided so that the toner image primarily transferred to the outer circumferential surface of the intermediate transfer belt 31 is secondarily transferred to a sheet of recording paper 9. A secondary transfer roll 35 which is disposed so as to be driven to rotate by the support roll 32*b* as a driving roll in such a manner that the secondary transfer roll 35 comes into contact with a portion of the outer circumferential surface of the intermediate transfer belt 31 laid on the support roll 32*b* and to which a secondary transfer bias voltage is applied, is used as the secondary transfer device 35. In the secondary transfer device 35, an unfixed toner image held on the intermediate transfer belt 31 is electrostatically secondarily transferred to the sheet of recording paper 9 conveyed and fed to a position between the intermediate transfer belt 31 and the secondary transfer roll 35.

The fixing device 45 is provided so that the secondarily transferred unfixed toner image is fixed to the sheet of recording paper 9. The fixing device 45 is disposed in a position above the secondary transfer device 35. The fixing device 45 includes a roll-type or belt-type heating rotary body 46, and a roll-type or belt-type pressure rotary body 47. The heating rotary body 46 has a fixing surface heated to a predetermined temperature by a heating means. The pressure rotary body 47 forms a fixing portion through which a recording medium 9 (a subject to be fixed) coming into contact with the fixing surface of the heating rotary body 46 with a required pressure and holding an unfixed toner image passes. In the fixing device 45, the recording medium 9 to which the unfixed toner image has been transferred is introduced into the fixing processing portion between the heating rotary body 46 and the pressure rotary body 47 and heated and pressed in the fixing processing portion, so that the unfixed toner image is melted and fixed to the sheet of recording paper 9.

After the sheet of recording paper 9 after fixing is ejected from the fixing device 45, the sheet of recording paper 9 is conveyed by an ejection roll 48, ejected through the ejection port 16 and stacked in the ejection/stack portion 15. In this manner, a monochromatic or polychromic image composed of one developing agent or a plurality of developing agents is formed on one surface of the sheet of recording paper 9.

Configuration, etc. relevant to the rear cover 14 will be described below.

Figure 4:
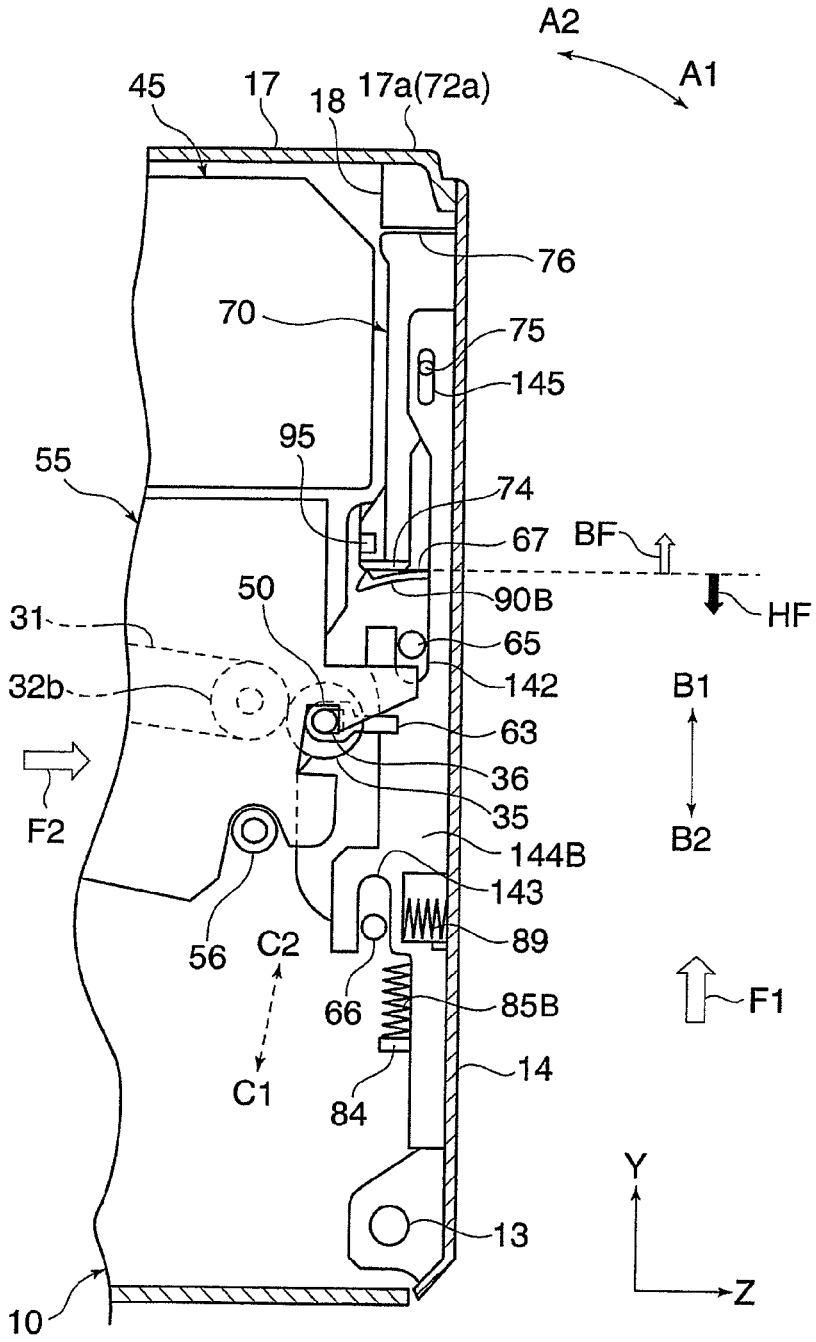
FIG. 4 is a schematic sectional view taken substantially along the line Q-Q in FIG. 3, showing a state of the image forming apparatus when a rear cover is closed.
Figure 5:
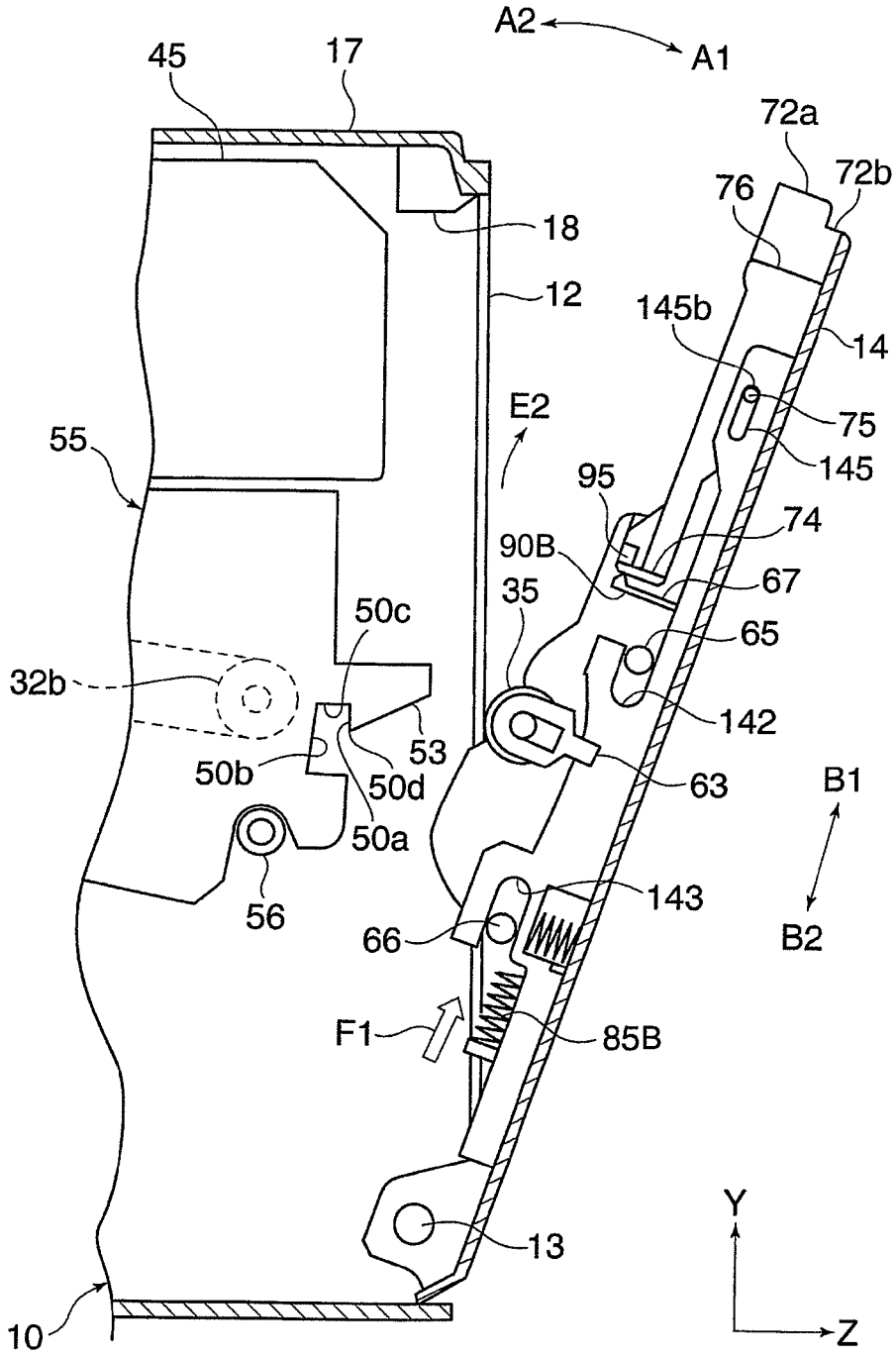
FIG. 5 is a schematic sectional view showing a state of the image forming apparatus in FIG. 4 when the rear cover is opened.

First, the image forming apparatus 1 uses a structure in which the secondary transfer roll 35 as the secondary transfer device is held in the rear cover 14 as shown in FIGS. 2, 4, 5, etc. In addition, in order to determine the position where the secondary transfer roll 35 should be disposed, positioning grooves 50 for accommodating and retaining shaft portions 36 of the secondary transfer roll 35 are used as fixing means when the rear cover 14 is closed. That is, the image forming apparatus 1 has such a mechanism that the rear cover 14 is fixed by the positioning grooves 50 through the secondary transfer roll 35 because the position of the secondary transfer roll 35 is retained by the positing grooves 50 on the side of the apparatus body 10 so that the position of the rear cover 14 retaining the secondary transfer roll 35 is also retained.

FIG. 4 shows a state concerned with main part of the image forming apparatus 1 when the rear cover 14 is closed. FIG. 5 shows a state concerned with main part of the image forming apparatus 1 when the rear cover 14 is opened. The open state of the rear cover 14 shown in FIG. 5 is a state when the rear cover 14 is opened in a midway position before a full open position of the rear cover 14.

The positioning grooves 50 are provided as a pair of left and right grooves in one end portion of a unit support frame 55 which supports the intermediate transfer unit 30 from its opposite (left and right) sides. Particularly, the positioning grooves 50 are formed in the end portion of the unit support frame 55 on the side of presence of the support roll 32*b* disposed in the secondary transfer position of the intermediate transfer belt 31, so that the secondary transfer roll 35 can be retained in a position where the secondary transfer roll 35 should be disposed for forming a transfer processing portion (nip portion) when the secondary transfer roll 35 comes into contact with the support roll 32*b* through the intermediate transfer belt 31. In addition, the positioning grooves 50 are formed as a pair of left and right grooves in the one end portion of the unit support frame 55. The term "pair of left and right grooves" means a state in which the positioning grooves 50 are disposed in respective positions opposite to the shaft portions 36*a* and 36*b* protruding from the opposite end portions in a shaft direction D of the secondary transfer roll 35.

In addition, each of the positioning grooves 50 is formed as a rectangular groove shape which is depressed with respect to an upper side in the gravitational direction while being slightly slanted toward the rear cover 14 side but an end portion on a lower side in the gravitational direction is opened. That is, each positioning groove 50 is formed as a groove surrounded by a first side wall portion 50*a* near to the rear cover 14, a second side wall portion 50*b* substantially parallel with the first side wall portion 50*a* and far from the rear cover 14, and a groove bottom portion 50*c* (FIG. 5). In each positioning groove 50, the side wall portions 50*a* and 50*b* extend along a direction substantially vertical to the surface of the intermediate transfer belt 31 laid over the two support rolls 32*a* and 32*b*.

The unit support frame 55 is retained in a required state inside the apparatus body 10 by positioning protrusive portions 56 provided in the apparatus body 10. In Embodiment 1, one positioning protrusive portion 56 is provided in front and a pair of positioning protrusive portions 56 are provided in left and right of the rear, so that the unit support frame 55 is retained by three positioning protrusive portions 56 in total. In addition, the support roll 32*b* disposed in the secondary transfer position is kept pressed against the secondary transfer roll 35 by a pressure spring not shown. In this manner, when the shaft portions 36 of the secondary transfer roll 35 are fitted into the positioning grooves 50, the roll body of the secondary transfer roll 35 comes into contact with the support roll 32*b* through the intermediate transfer belt 31 and is pressed by the support roll 32*b* at the same time, so that a required pressure is generated in the transfer processing portion formed between the secondary transfer roll 35 and the support roll 32*b*. The secondary transfer roll 35 has a structure in which an elastic body layer 35*b* made of a material such as foamed urethane containing a conductive substance is formed around a shaft 35*a*.

In addition, a guide slope 53 is provided in an outer portion of each positioning groove 50 in the unit support frame 55 and near the rear cover 14. When the rear cover 14 is closed, the guide slope 53 comes into contact with the shaft portion 36 of the secondary transfer roll 35 and guides the shaft portion 36 into the positioning groove 50.

The guide slope 53 is formed to be located in such a position that the shaft portion 36 of the secondary transfer roll 35 attached to the rear cover 14 comes into contact with the guide slope 53 on a track (circular arc curve designated by a chain line K in FIG. 16) when the rear cover 14 pivots on the hinge 13. In addition, as shown in FIG. 5 or the like, the guide slope 53 is formed as a slope which is inclined at a required angle so that the guide slope 53 ascends in the gravitational direction as a position of the guide slope 53 comes near to the rear cover 14 from an apex portion of the first side wall portion 50*a* of the positioning groove 50 (an end point portion located at a lower end in this example). The positioning groove 50 is shaped like a hook as a whole when the positioning groove 50 including the guide slope 53 is viewed.

On the other hand, as shown in FIGS. 4 to 7 or the like, the rear cover 14 is formed so that a roll retaining frame 60 for retaining the secondary transfer roll 35, an operation button 70 for operating an open/close operation of the rear cover 14 and a pressure member retaining frame 80 for retaining pressure springs pressing the roll retaining frame 60 are attached to the inner side (the side facing the inside of the apparatus body 10) of the rear cover 14. Incidentally, each of the rear cover 14, the roll retaining frame 60, the operation button 70 and the pressure member retaining frame 80 in Embodiment 1 is a resin molded piece which is produced from a synthetic resin by a required plastic molding method.

Figure 6:
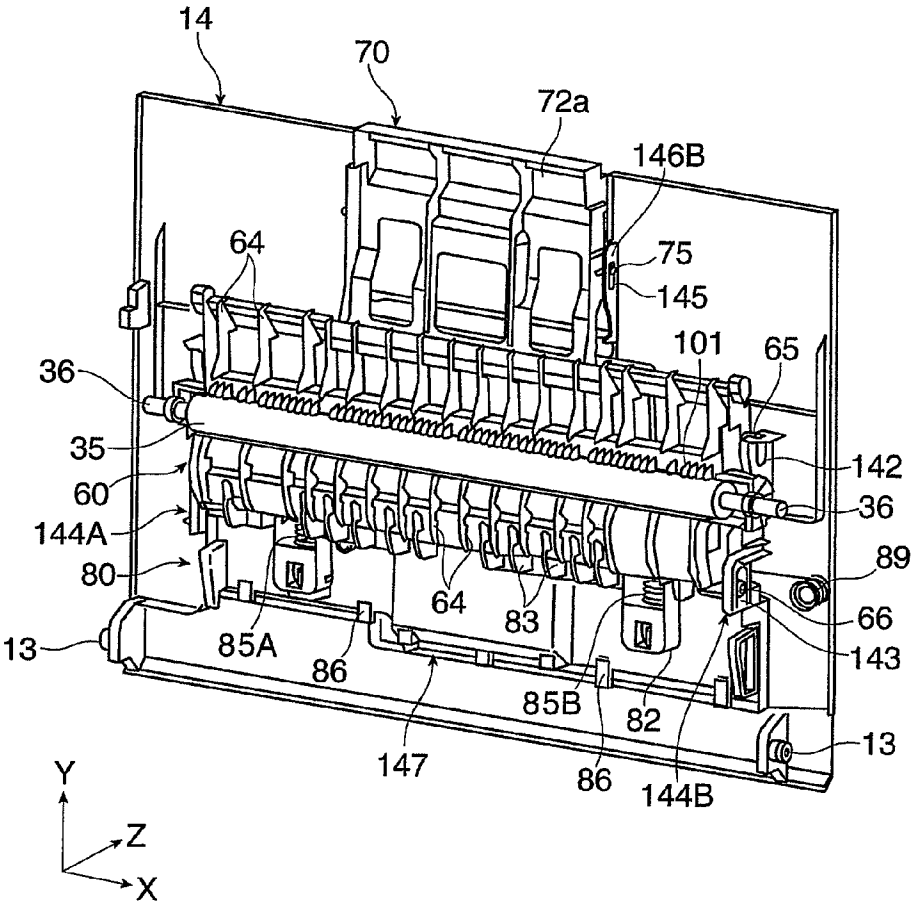
FIG. 6 is a perspective view showing a state of an inner side of the rear cover.
Figure 8:
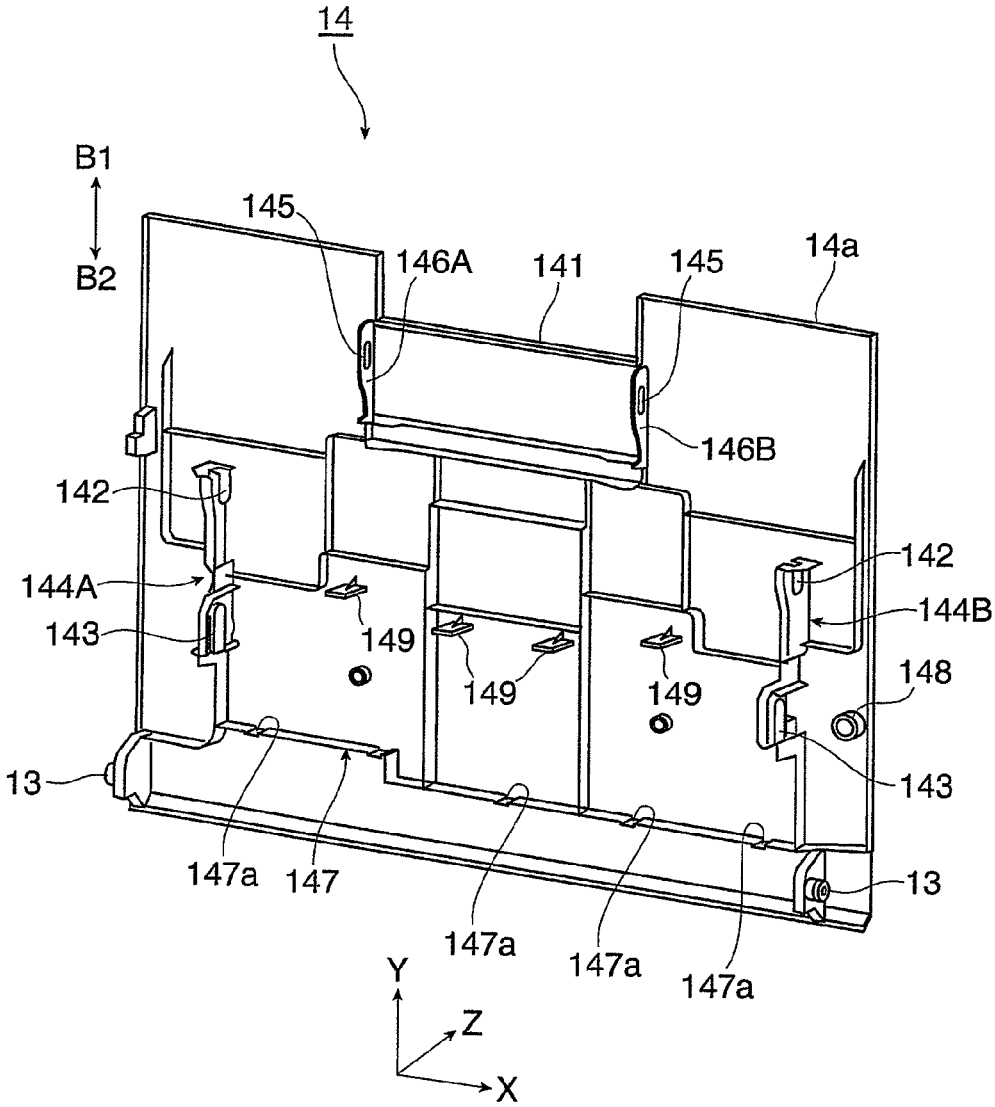
FIG. 8 is a perspective view showing a single rear cover.

First, as shown in FIGS. 3, 6, 8, etc., the rear cover 14 is a plate member which is substantially formed to have a rectangular shape as its outer shape. The hinges 13 serving as a pivot of swinging motion for opening/closing the rear cover 14 are formed in opposite sides of a lower portion of the rear cover 14. A button arrangement portion 141 is formed substantially in the center of an upper end portion of the rear cover 14 so that an upper portion of the operation button 70 is movably exposed to the outside (the outside of the rear cover 14). The button arrangement portion 141 is formed to have a shape corresponding to the shape and size of the operation button 70.

In addition, the rear cover 14 is provided with a pair of left and right guide plates 144A and 144B on opposite sides in the left-right direction (direction along the coordinate axis Z) in a substantially middle portion of the rear cover 14 in the up-down direction (direction along the coordinate axis Y). The guide plates 144A and 144B include upper guide grooves 142 and lower guide grooves 143 which are formed for supporting the roll retaining frame 60 so that the roll retaining frame 60 can be moved in directions indicated by arrows B1 and B2. Each upper guide groove 142 is shaped like a U figure having an opened upper end. Each lower guide groove 143 is shaped like a U figure having an opened lower end.

Further, the rear cover 14 is provided with a pair of left and right guide plates 146A and 146B on opposite (left and right) sides below the button arrangement portion 141. The guide plates 146A and 146B include guide holes 145 which support the operation button 70 so that the operation button 70 can be moved in the directions indicated by the arrows B1 and B2. Each guide hole 145 is shaped like a long hole having a length corresponding to an allowable movement range of the operation button 70.

As shown in FIG. 4, etc., the directions indicated by the arrows B1 and B2 are directions substantially along a direction C1 in which the shaft portions 36 of the secondary transfer roll 35 (can) go out of the positioning grooves 50 when the rear cover 14 is swung so as to be located in a close position. The directions indicated by the arrows B1 and B2 in Embodiment 1 are equivalent to directions in which the shaft portions 36 of the secondary transfer roll 35 move in the up-down direction and substantially in parallel with a plane of a plate member mainly constituting the rear cover when viewed on the basis of the rear cover 14.

The reference numeral 147 in FIG. 8, etc. designates an attachment plate (rib) for attaching a lower portion of the pressure member retaining frame 80. Insertion holes 147*a* are formed in the attachment plate 147 so that insertion portions (86) provided in the lower portion of the pressure member retaining frame 80 are inserted and fixed into the insertion holes 147*a* respectively. In addition, the reference numeral 148 designates a retaining portion for retaining one end of a pressure spring (89) formed integrally with a pressure spring 85B which will be described later. Further, the reference numeral 149 designates a fixation plate for fixing an upper end portion of the pressure member retaining frame 80.

Figure 7:
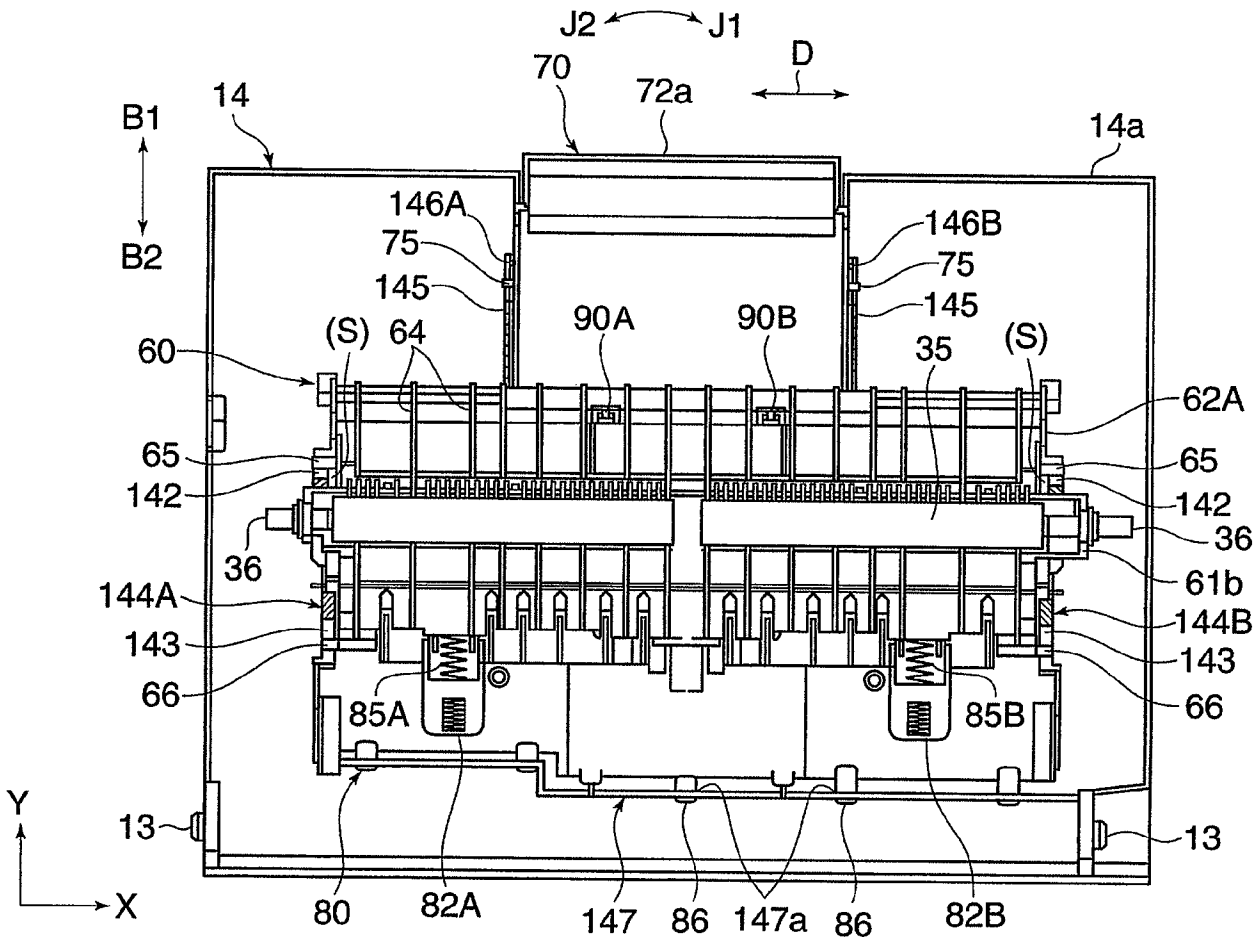
FIG. 7 is a front view showing a state of an inner surface side of the rear cover in FIG. 6, when seen from a front direction.
Figure 9:
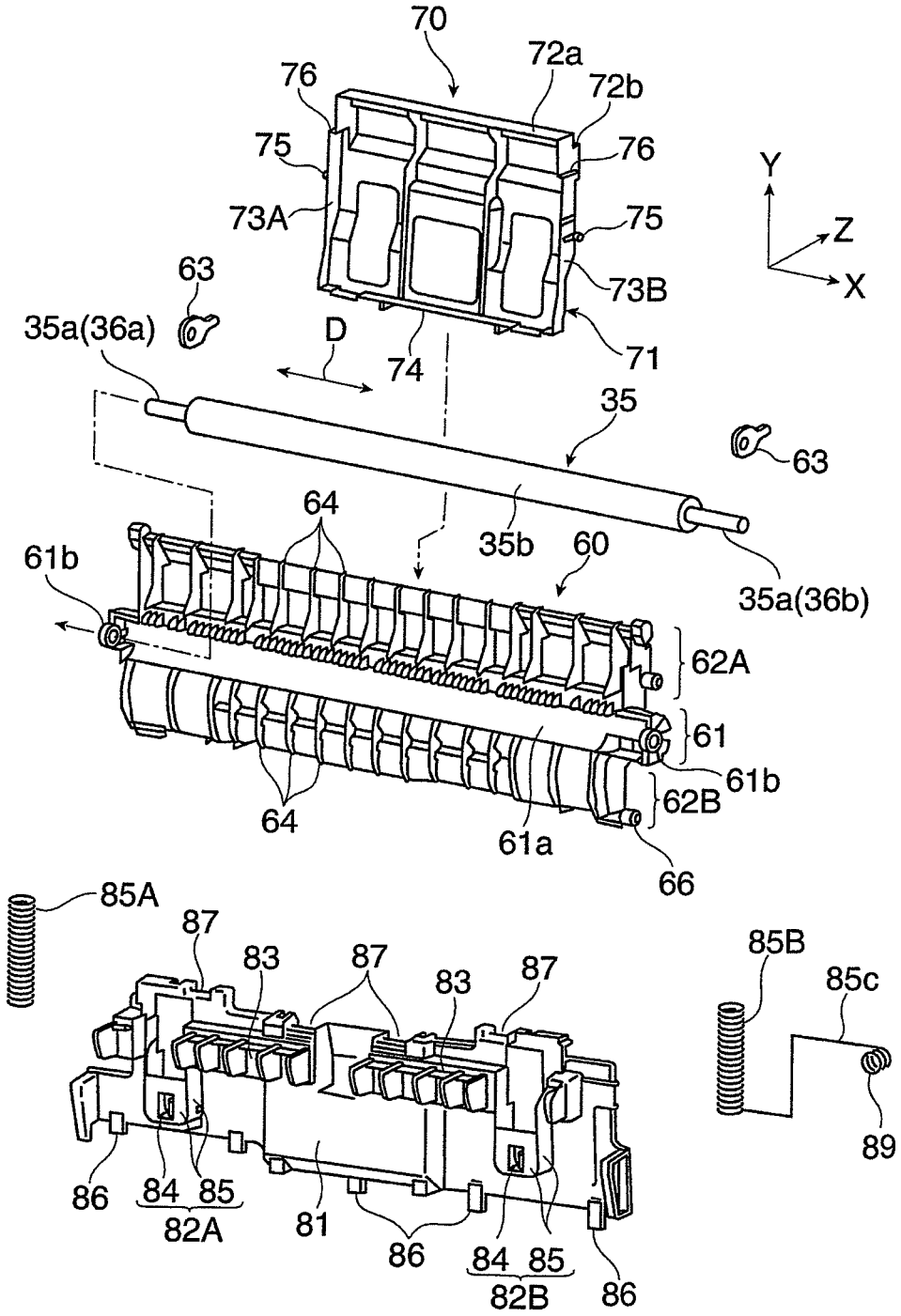
FIG. 9 is an exploded perspective view showing a state in which constituent components to be attached to the rear cover are exploded.

As shown in FIGS. 6, 7, 9, etc., the roll retaining frame 60 includes a roll retaining portion 61, an upper (downstream side in a sheet conveyance direction) sheet guide portion 62A, and a lower (upstream side in the sheet conveyance direction) sheet guide portion 62B. The roll retaining portion 61 retains the secondary transfer roll 35 substantially in the center portion of the roll retaining frame 60 in the up-down direction. The sheet guide portions 62A and 62B exist as up-down extensions of the roll retaining portion 61 and guide a sheet of recording paper 9 passing through the secondary transfer position, along the conveyance direction.

The roll retaining portion 61 includes a body portion 61*a*, and bearing portions 61*b*. The body portion 61*a* is formed to have a semi-cylindrical curved surface. The bearing portions 61*b* are formed in opposite end portions of the body portion 61*a* in order to support the shaft portions 36 of the secondary transfer roll 35. The secondary transfer roll 35 is attached to the roll retaining portion 61 so as to be rotatable in such a state that the shaft portions 36 of the secondary transfer roll 35 pass through bearing holes of the bearing portions 61*b*, and then are surely pulled and fixed to the bearing portions 61*b* by bearings 63. In addition, each of the upper sheet guide portion 62A and the lower sheet guide portion 62B is formed in such a manner that plate-like guide protrusive portions (ribs) 64 having curved guide portions (edge portions) formed in accordance with the sheet conveyance direction are disposed at predetermined intervals in the shaft direction D of the secondary transfer roll 35.

In addition, in the roll retaining frame 60, upper protrusive portions 65 and lower protrusive portions 66 which can be inserted and guided into the guide grooves 142 and 143 of the rear cover 14 are provided in left and right side portions of the upper sheet guide portion 62A and the lower sheet guide portion 62B, respectively. The upper and lower protrusive portions 65 and 66 are formed so as to protrude outward from the respective left and right side portions of the sheet guide portions 62A and 62B. Each of the protrusive portions 65 and 66 is formed like a cylinder whose diameter is set to be substantially equal to (slightly narrower than) the groove width of each of the guide grooves 142 and 143.

Figure 10:
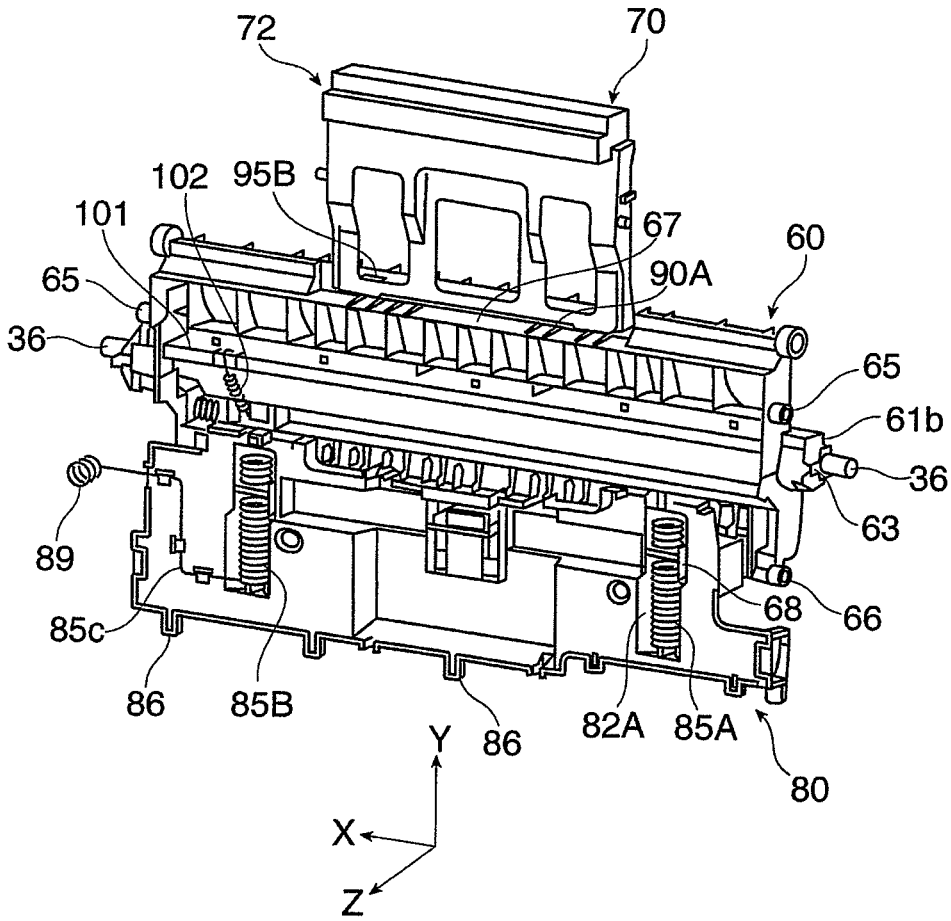
FIG. 10 is a perspective view showing a state of the constituent components attached to the rear cover, when the constituent components are seen as a whole from the rear cover side.
Figure 11:
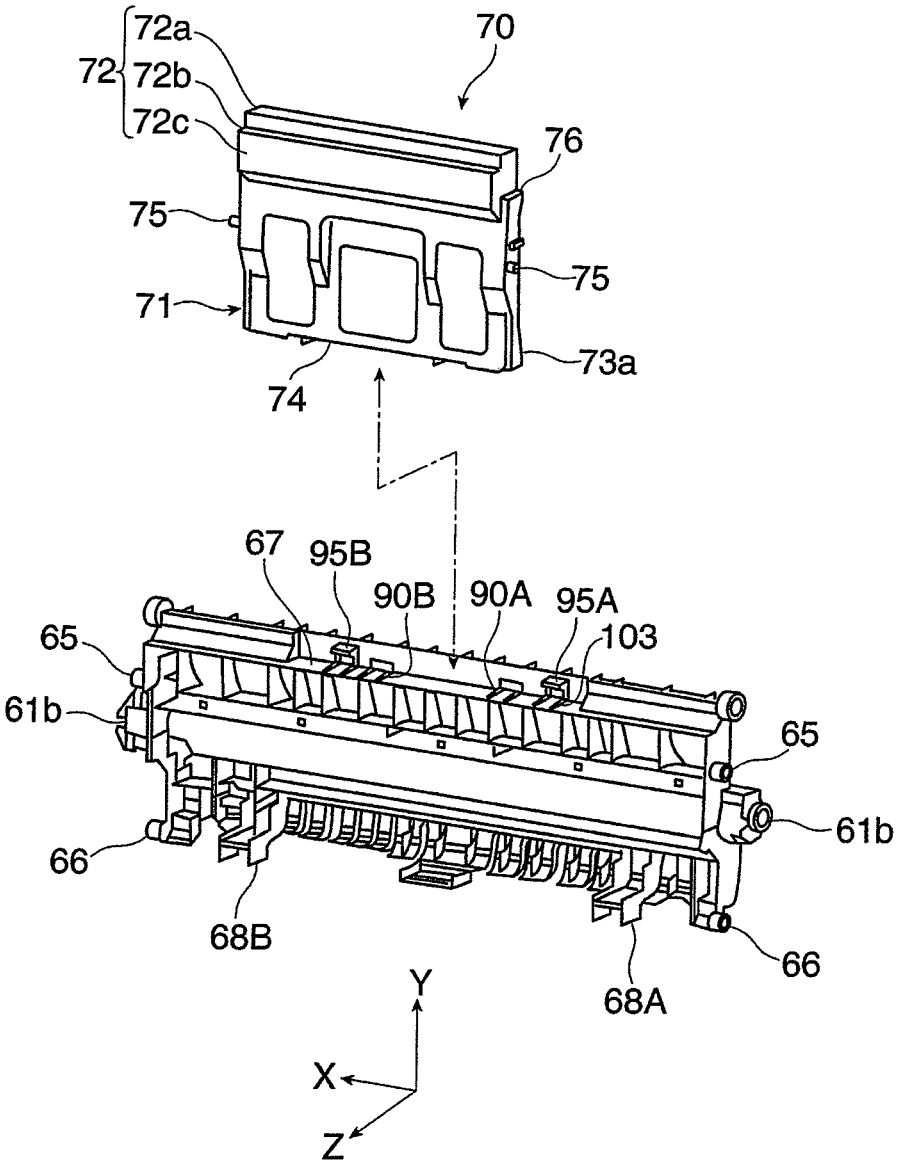
FIG. 11 is an exploded perspective view showing a state in which part (a roll retaining frame and an operation button) of the constituent components in FIG. 10 are exploded.

Further, as shown in FIGS. 4, 10, 11, etc., in the roll retaining frame 60, a contact surface portion 67 which comes into contact with a lower surface portion of the operation button 70 (a lower surface 74*a* of a bottom plate portion 74) is provided in an upper end portion of the upper sheet guide portion 62A.

In addition, as shown in FIGS. 10, 11, etc., in the roll retaining frame 60, a pair of spring bearing plate portions 68 are provided in portions slightly inward of the opposite (left and right) end portions in a lower portion of a region of the roll retaining frame 60 facing the rear cover 14, so that the spring bearing plate portions 68 come into contact with and hold part of pressure springs 85A and 85B which will be described later. Each of the spring bearing plate portions 68 is formed to have a shape which can be fitted into a corresponding spring receiving portion 82A (82B) (which will be described later) of the pressure member retaining frame 80 to thereby retain the pressure springs 85A and 85B.

As shown in FIGS. 5, 6, 9, etc., the operation button 70 includes a body portion 71, and an operation portion 72 which is formed on top of the body portion 71.

Figure 13:
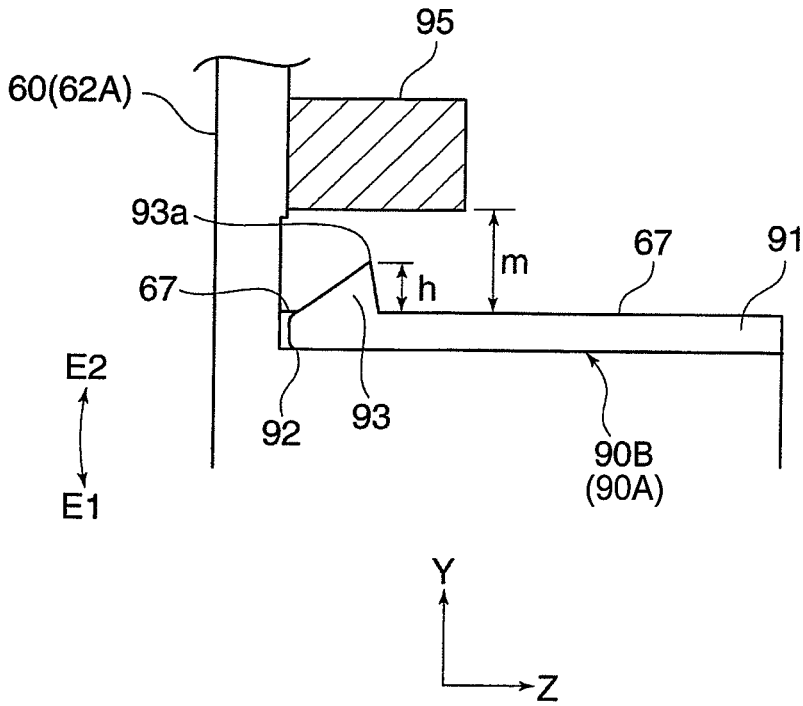
FIG. 13 is an explanatory view showing configuration of a leaf spring portion and a hook portion.

The body portion 71 is provided in such a manner that side plate portions 73A and 73B are formed in left and right side portions of a rectangular plate-like substrate 71*a* and a bottom plate portion 74 is formed in the bottom of the substrate 71*a*. A lower surface 74*a* of the bottom plate portion 74 faces and comes into contact with the contact surface portion 67 in the roll retaining frame 60 (FIG. 4 and FIG. 13). The operation portion 72 includes a top surface portion 72*a*, and a side surface portion 72*c* protruding backward through a step portion 72*b*.

In addition, in the operation button 70, protrusive portions 75 which are inserted and guided into the guide holes 145 of the rear cover 14 are provided substantially in vertically center portions of the side plate portions 73A and 73B of the body portion 71 so as to protrude on left and right sides.

Further, in the operation button 70, bumping portions 76 are provided in upper end portions which also are substantially border portions between the operation portion 72 and the side plate portions 73A and 73B of the body portion 71. The bumping portions 76 bump to-be-bumped portions 18 provided in inner surface sides of a top cover (exterior member) 17 of the apparatus body 10 to stop movement of the operation button 70 when the rear cover 14 is closed. The bumping portions 76 are shaped like steps protruding leftward and rightward from the side surfaces of the operation portion 72 respectively. As shown in FIGS. 3 to 5, etc., the to-be-bumped portions 18 are formed to face left and right end portions of a button exposing notch portion 19 formed substantially in the center portion of a rear end portion of the top cover 17.

As shown in FIGS. 6, 7, 9, 10, etc., the pressure member retaining frame 80 includes a plate-like body portion 81, a pair of spring receiving portions 82A and 82B which are formed in sides slightly inward of left and right end portions of the body portion 81 in order to receive pressure springs 85A and 85B, and sheet guide portions 83 which are formed in an upper portion of the body portion 81 and between the pair of spring receiving portions 82A and 82B.

The pressure springs 85A and 85B are a pair of coiled springs for pressing the roll retaining frame 60 in the direction indicated by the arrow B1 (direction substantially along the direction of fitting of the shaft portions 36 into the positioning grooves 50). A pressure spring which is formed integrally with another spring portion 89 through an extension line portion 85*c* extended from a lower end portion of the pressure spring is used as one 85B of the pressure springs 85A and 85B. The other spring portion 89 is a constituent component for grounding a destaticizing member 101 (which destaticizes the rear surface of the sheet of paper 9 after secondary transfer) placed in a border portion between the body portion 61*a* of the roll retaining portion 61 and the upper guide portion 62A. Specifically, the destaticizing member 101 and the (conductive) pressure spring 85B, hence, the spring portion 89 are connected to each other by a conductive member (conductive spring) 102, so that the spring portion 89 electrically connected to the destaticizing member 101 can come into contact with a grounded constituent portion of the apparatus body 10 when the rear cover 14 is closed.

Each of the pair of spring receiving portions 82A and 82B is made up of a spring retaining bottom plate 84 and a side plate 85. The spring retaining bottom plate 84 retains a lower end portion of the pressure spring 85A (85B). The side plate 85 surrounds a lower side portion of the pressure spring 85A (85B). Each of the sheet guide portions 83 is made from a plurality of plate-like guide protrusive portions disposed to be superimposed on the lower protrusive portion 66 in the lower sheet guide portion 62B of the roll retaining frame 60.

In addition, a plurality of insertion portions 86 are provided in a lower end portion of the body portion 81 of the pressure member retaining frame 80. The insertion portions 86 are inserted and fixed into the insertion holes 147*a* formed in the attachment plate 147 of the rear cover 14. Further, fixation accepting portions 87 are formed in an upper end portion of the body portion 81. The fixation plates 149 formed in the rear cover 14 come into contact with the fixation accepting portions 87 so as to be fixed thereto.

As shown in FIG. 4, FIGS. 10 to 14 etc., leaf spring portions 90A and 90B are provided in the contact surface portion 67 of the roll retaining frame 60 in the image forming apparatus 1 so that the leaf spring portions 90A and 90B come into contact with a lower portion of the operation button 70.

As shown in FIGS. 11, 13, etc., each of the leaf spring portions 90A and 90B is formed in a state where a part of the contact surface portion (plate portion) 67 is cut into a long and narrow plate-like piece. Particularly, each of the leaf spring portions 90A and 90B has a root portion 91 which is disposed continuously to the contact surface portion 67, and an end portion 92 which is an elastically deformable free end extended from the root portion 91. That is, each of the leaf spring portions 90A and 90B is a cantilever-shaped leaf spring. The free end 92 is elastically deformed so as to be bent in directions indicated by arrows E1 and E2 due to flexibility of synthetic resin (molded piece) for forming the retaining frame 60.

Figure 14:
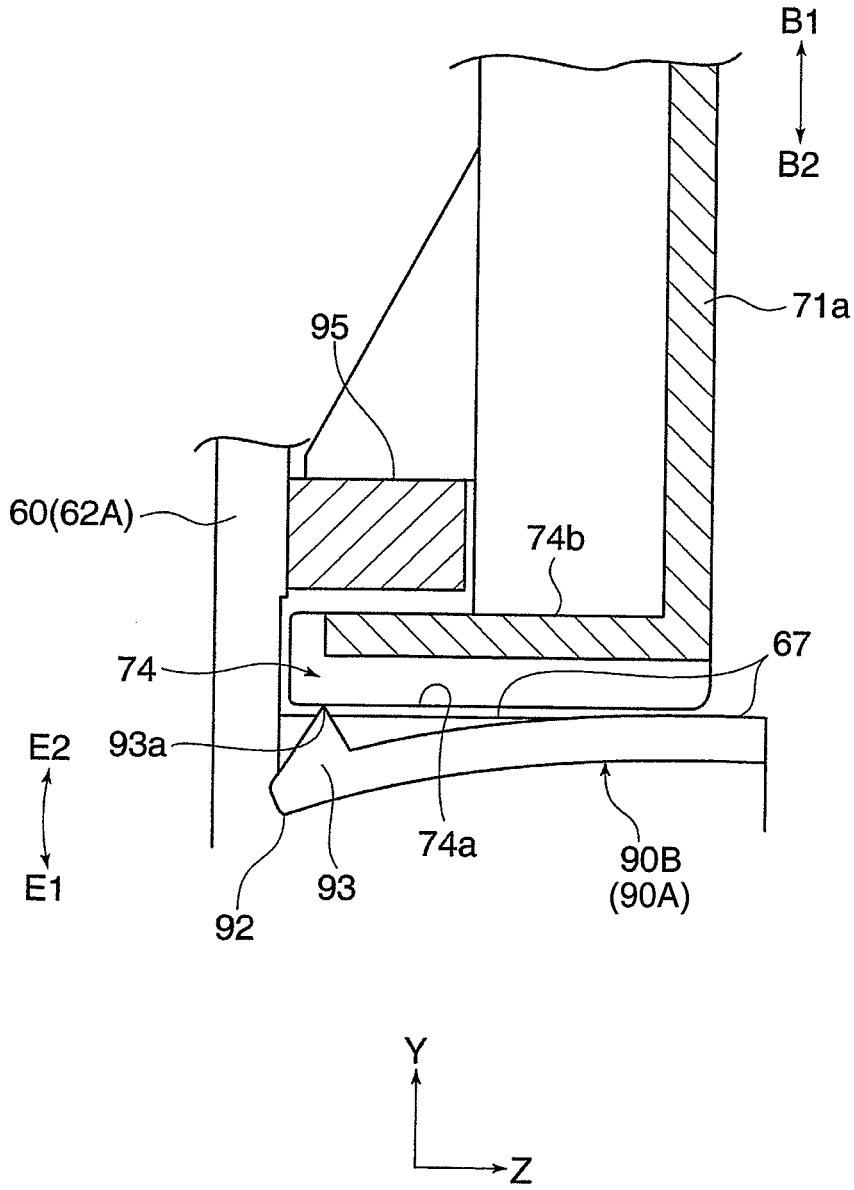
FIG. 14 is an explanatory view showing the relation of the leaf spring portion and the hook portion with the operation button in FIG. 13.

A protrusive portion 93 is provided on a top surface side of the free end 92 so that the protrusive portion 93 protrudes upward from the surface of the contact surface portion 67 in a state where the leaf spring portion 90A (90B) is not bent. The sectional shape of the protrusive portion 93 along the lengthwise direction of the leaf spring portion 90A (90B) is triangular. A pointed tip end portion 93*a* of the protrusive portion 93 is a portion which actually comes into contact with the lower portion of the operation button 70 (the lower surface 74*a* of the bottom plate portion 74 of the body portion) (FIG. 14). The protrusive portion 93 is formed so that the tip end portion 93*a* has a required height h from the contact surface portion 67. The height h of the protrusive portion 93 is one factor for determining the magnitude of spring force BF of the leaf spring portion 90A (90B).

The leaf spring portions 90A and 90B are provided in two places of the contact surface portion 67 of the roll retaining frame 60 in the left-right direction (equivalent to the shaft direction D of the secondary transfer roll 35). Specifically, the leaf spring portions 90A and 90B are provided in symmetric positions which are equally spaced from a center portion of the contact surface portion 67 (also serving as a center portion of the upper guide portion 62A) in the left-right direction toward opposite (left and right) sides.

In addition, as shown in FIG. 4, FIGS. 10 to 14, etc., hook portions 95A and 95B are provided in the contact surface portion 67 of the roll retaining frame 60 in the image forming apparatus 1. The hook portions 95A and 95B come into contact with the lower portion of the operation button 70 so as to be connected to the operation button 70.

Figure 16:
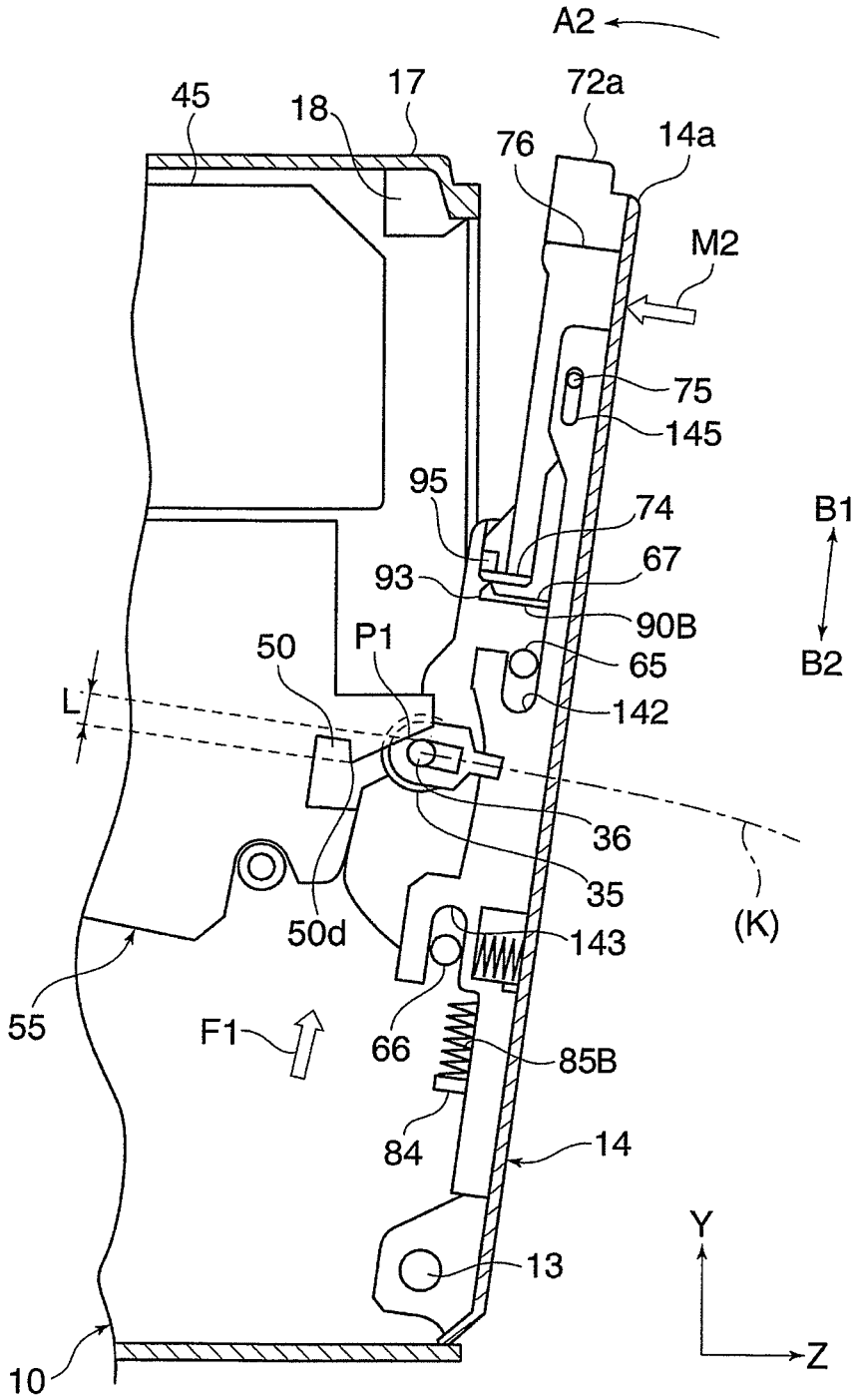
FIG. 16 is a schematic sectional explanatory view showing operation and behavior when the rear cover closes.

When the rear cover 14 is closed, the shaft portions 36 of the secondary transfer roll 35 are guided by the guide slopes 53 in front of the positioning grooves 50 and displaced in the direction of the arrow B2 so that the roll retaining frame 60 moves in the same direction. The hook portions 95A and 95B serve for moving the operation button 70 together with the roll retaining frame 60 in the direction of the arrow B2 likewise (FIG. 16).

As shown in FIGS. 13, 14 etc., each of the hook portions 95A and 95B is formed to protrude from the wall surface of the upper guide portion 62A of the roll retaining frame 60 so as to be located above the contact surface portion 67 so that the hook portion 95A (95B) can come into contact with an upper surface 74*b* of the bottom plate portion 74 of the body portion of the operation button 70. A gap (spaced distance) m between the hook portion 95A (95B) and the contact surface portion 67 is set at a value larger than the thickness of the bottom plate portion 74 of the body portion of the operation button 70. In this manner, the bottom plate portion 74 of the body portion of the operation button 70 can move in the direction of the arrow B1 or B2 by a required distance between the contact surface portion 67 and the hook portion 95A (95B). Each of the hook portions 95A and 95B is formed to be adjacent to a position of the outer side in each of the two leaf spring portions 90A and 90B.

Further, in the image forming apparatus 1, the roll retaining frame 60 (the left and right side surface portions of the upper and lower guide portions 62A and 62B) is attached to the pair of left and right guide plates 144A and 144B with a gap S for allowing displacement (FIG. 7). In this manner, the opposite end portions of the roll retaining frame 60 in the width direction (the direction along the shaft direction D of the secondary transfer roll 35) move by different quantities in the direction of the arrow B1 or B2 (the arrow B2 when the rear cover 14 is closed) relative to the rear cover 14 so that the retaining frame as a whole is displaced to be slanted in a direction indicated by an arrow J1 or J2.

Figure 12:
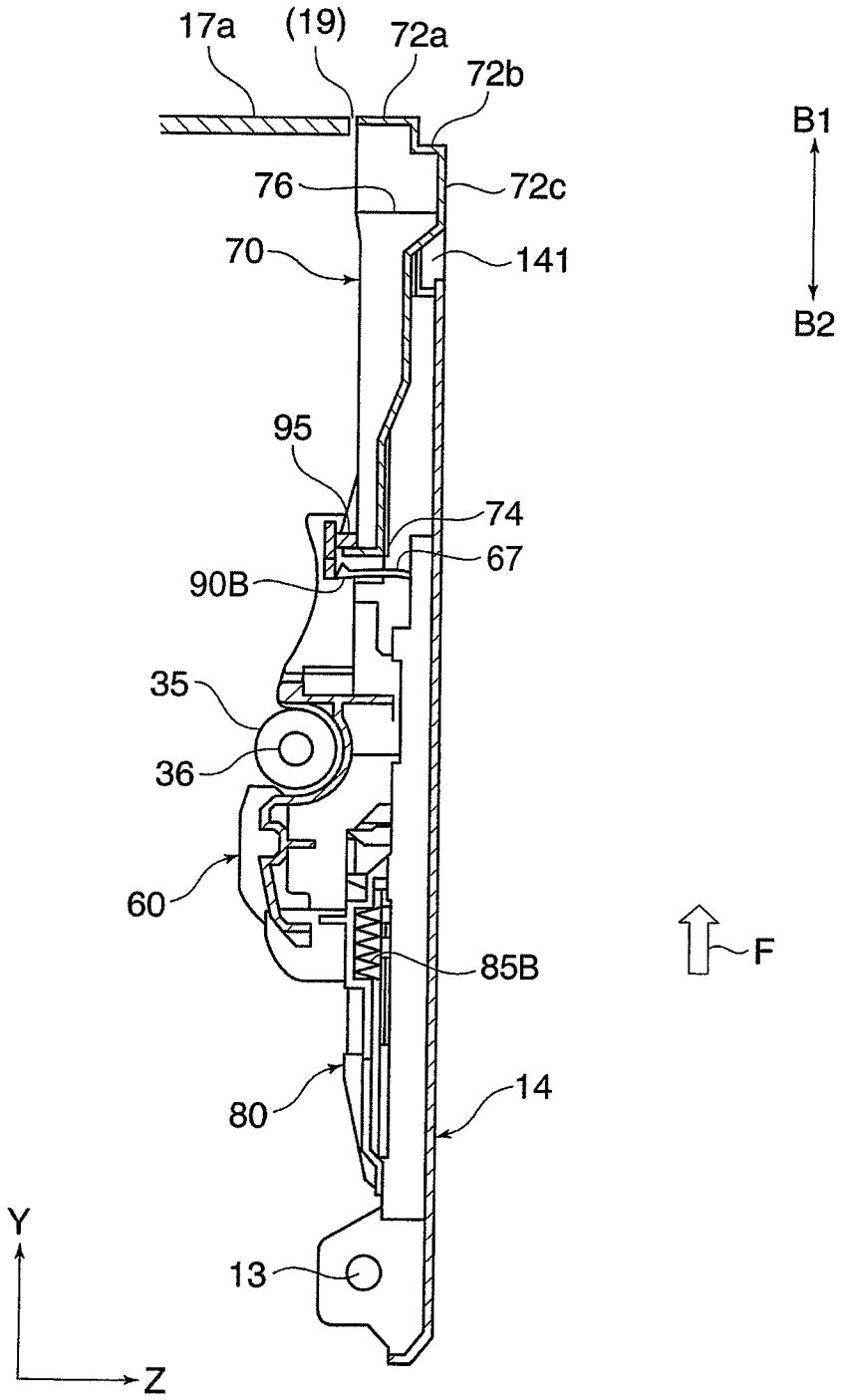
FIG. 12 is a sectional explanatory view showing a state of the rear cover, etc. when the rear cover is in a close state (position)

In addition, as shown in FIGS. 3, 12, etc., the top surface portion 72*a* in the operation portion 72 of the operation button 70 is formed into a flat surface shape stepless and continuous to the portions 17*a* in the periphery of the button exposing notch portion 19 in the top cover 17 of the apparatus body 10. In addition, the side surface portion 72*c* in the operation portion 72 is formed into a flat surface shape which is stepless and continuous to the outer surface of the rear cover 14.

The roll retaining frame 60, the operation button 70, the pressure member retaining frame 80 etc. configured in the aforementioned manner are attached to the inner side of the rear cover 14, for example, in the following procedure. Incidentally, the rear cover 14 is attached to the open portion 12 formed on the rear side of the apparatus body 10 through the hinges 13.

First, the pressure member retaining frame 80 is attached to the inner side of the rear cover 14. Specifically, after the pressure springs 85A and 85B are received in the spring receiving portions 82A and 82B, the insertion portions 86 in the pressure member retaining frame 80 are inserted into the insertion holes 147*a* of the attachment plate 147 in the rear cover 14 and the fixation accepting portions 87 are fixed to the fixation plates 149 in the rear cover 14. In this manner, the pressure member retaining frame 80 is attached while fixed to the rear cover 14.

Successively, the roll retaining frame 60 is attached while connected to the top of the pressure member retaining frame 80 in the condition that the pressure member retaining frame 80 has been attached to the rear cover 14. Specifically, the roll retaining frame 60 is attached in the condition that the spring bearing plate portions 68A and 68B are inserted into the upper portions of the pressure springs 85A and 85B exposed from the spring receiving portions 82A and 82B of the pressure member retaining frame 80 after the secondary transfer roll 35 is mounted into the roll retaining frame 60. The upper and lower protrusive portions 65 and 66 in the sheet guide portions 62A and 62B are fitted into the guide grooves 142 and 143 of the guide plates 144A and 144B in the rear cover 14, respectively.

In this manner, the roll retaining frame 60 is attached to the rear cover 14 to be movable in the directions indicated by the arrows B1 and B2. In addition, the roll retaining frame 69 is kept pressed by the pressure springs 85A and 85B in the direction of the arrow B1 (up direction).

Finally, the operation button 70 comes into contact with the top of the roll retaining frame 60 to be attached thereto in the condition that the roll retaining frame 60 has been attached to the rear cover 14. Specifically, after the bottom plate portion 74 as the lower portion of the operation button 70 is brought into contact with the contact surface portion 67 of the roll retaining frame 60, the protrusive portions 75 are fitted into the guide holes 145 of the guide plates 146A and 146B in the rear cover 14. On this occasion, the bottom plate portion 74 of the operation button 70 is inserted into the gap between the contact surface portion 67 and the hook portions 95A and 95B and the lower surface 74*a* of the bottom plate portion 74 comes into contact with the protrusive portions 93 of the leaf spring portions 90A and 90B, as shown in FIG. 14 etc.

In this manner, the operation button 70 is attached to the rear cover 14 so as to be movable in the directions indicated by the arrows B1 and B2. In addition, the bottom plate portion 74 of the operation button 70 is inserted between the contact surface portion 67 of the roll retaining frame 60 and the hook portions 95A and 95B while kept in contact with the leaf spring portions 90A and 90B. In addition, in the operation button 70, the operation portion 72 is retained to be disposed in the button arrangement portion 141 of the rear cover 14.

Next, an open/close operation of the rear cover 14 will be described.

FIG. 3 and FIG. 4 show the state when the rear cover 14 is in the close position. Since the shaft portions 36 of the secondary transfer roll 35 go into the positioning grooves 50 provided on the apparatus body 10 side and are retained in terms of position in the positioning grooves 50 on this occasion, the position of the rear cover 14 is kept fixed (fixed in the close position continuously) through the roll retaining frame 60 retaining the secondary transfer roll 35.

In addition, on this occasion, the roll retaining frame 60 is pressed in the up direction indicated by the arrow B1 (the direction along a direction C2 in which the shaft portions 36 go into the positioning grooves 50) by spring force F1 of the pressure springs 85A and 85B so that the shaft portions 36 of the secondary transfer roll 35 are surely retained in the positioning grooves 50. In addition, pressure F2 is applied to the secondary transfer roll 35 from the support roll 32*b* of the intermediate transfer unit 30, so that the secondary transfer roll 35 is kept pressed against first side wall portions 50*a* (FIG. 5) of the positioning grooves 50.

Further, on the occasion, because the roll retaining frame 60 pressed by the pressure springs 85A and 85B is in contact with the operation portion 70 in the contact surface portion 67, the operation button 70 is pressed and moved in the up direction indicated by the arrow B1. In this manner, the bumping portions 76 of the operation button 70 bump the to-be-bumped portions 18 of the top cover 17, so that the operation button 70 is impeded from moving so as to be kept still. On this occasion, the top surface portion 72*a* in the operation portion 72 of the operation button 70 is exposed to the outside from the button exposing notch portion 19 of the top cover 17 and forms a flat surface stepless and continuous to the top cover portion 17*a* which is the periphery of the button exposing notch portion 19 (FIGS. 3 and 12).

Successively, when the rear cover 14 is opened, the following operation will be performed.

Figure 15:
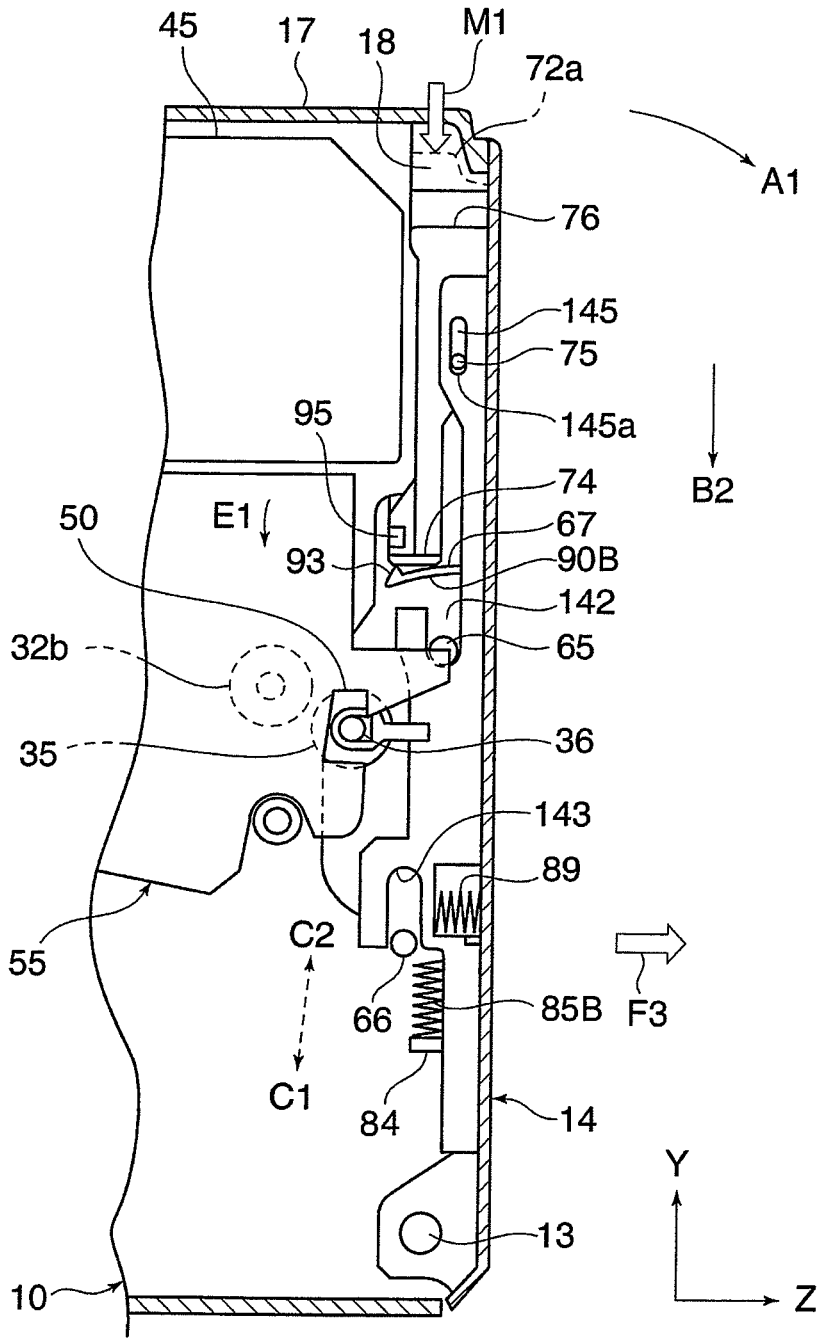
FIG. 15 is a schematic sectional explanatory view showing operation and behavior when the rear cover opens.

First, as shown in FIG. 15, an operator presses the operation button 70 in the down direction indicated by an arrow M1 by hand. In this manner, the operation button 70 moves in the down direction indicated by the arrow B2 along the guide holes 145.

On this occasion, the bottom plate portion 74 which is the lower portion of the operation button 70 touches and bumps the contact surface portion 67 of the roll retaining frame 60 pressed by the pressure springs 85A and 85B, so that the operation button 70 is moved together with the roll retaining frame 60 in the down direction indicated by the arrow B2 against the spring force F1 of the pressure springs 85A and 85B.

On this occasion, the bottom plate portion 74 of the operation button 70 comes into contact with the protrusive portions 93 of the leaf spring portions 90A and 90B in the contact surface portion 67 of the roll retaining frame 60 so that the leaf spring portions 90A and 90B are elastically deformed to be bent toward the down direction E1 and finally comes into direct contact with the surface of the contact surface portion 67 (particularly, the bottom plate portion 74 comes into contact with stop protrusions 103 below the hook portions 95A and 95B). In this manner, force by which the operation button 70 presses the roll retaining frame 60 downward is transmitted to the roll retaining frame 60. In addition, since the protrusive portions 75 come into contact with lower end portions 145*a* of the guide holes 145, movement of the operation button 70 in the down direction indicated by the arrow B2 is stopped.

In addition, although the movement force of the operation button 70 in the direction of the arrow B2 is transmitted to the roll retaining frame 60 through the leaf spring portions 90A and 90B, the leaf spring portions 90A and 90B are disposed in symmetric positions with respect to the center portion of the contact surface portion 67 so that the movement force can be transmitted to the roll retaining frame 60 without unbalance between the right and the left. In this manner, not only the operation button 70 but also the roll retaining frame 60 move smoothly along the guide holes 145 and the guide grooves 142 and 143.

As a result, the roll retaining frame 60 moves together with the operation button 70 in the direction indicated by the arrow B2 so that the shaft portions 36 of the secondary transfer roll 35 move in the direction C1 for going out of the positioning grooves 50. When the shaft portions 36 of the secondary transfer roll 35 then completely go out of the positioning grooves 50, the rear cover 14 comes into a condition to pivot in the direction indicated by the arrow A1 (direction to be open) on the hinges 13. On this occasion, the bumping portions 76 in the operation button 70 are separate from the to-be-bumped portions 18 of the top cover 17.

Accordingly, the rear cover 14 is slanted relative to the apparatus body 10 so as to open the open portion 12 of the apparatus body 10 to the outside, as shown in FIG. 5. In the opened rear cover 14, the roll retaining frame 60 is pressed by the spring force F1 of the pressure springs 85A and 85B to be moved in the up direction indicated by the arrow B1. In addition, the operation button 70 is also moved in the up direction indicated by B1 because the roll retaining frame 60 comes into contact with the lower portion of the operation button 70 in the contact surface portion 67.

On this occasion, the contact surface portion 67 of the roll retaining frame 60 comes in contact with the bottom plate portion 74 of the operation button 70 through the protrusive portions 93 of the leaf spring portions 90A and 90B moving in a restoration direction indicated by the arrow E2 by an elastic restoration force. In addition, since the protrusive portions 75 come into contact with upper end portions 145*b* of the guide holes 145, movement of the operation button 70 in the up direction indicated by the arrow B1 is impeded and stopped. The top surface portion 72*a* of the operation portion 72 of the operation button 70 protrudes slightly from an upper end portion 14*a* of the rear cover 14 (see FIGS. 6 and 16).

Successively, when the rear cover 14 is closed, the following operation will be performed.

First, as shown in FIG. 16, the operator pushes the rear cover 14 in a close direction indicated by an arrow M2 by hand. On this occasion, the operator may touch and push the operation button 70, but the operator does not have to operate the operation button 70 per se. When the rear cover 14 pivots in the direction indicated by the arrow A2 (the close direction) on the hinges 13 to approach to a position in front of the open portion 12 of the apparatus body 10, the shaft portions 36 of the secondary transfer roll 35 come into contact with the guide slopes 53 in front of the positioning grooves 50.

When the rear cover 14 is further pushed and swung in the close direction A2 after the shaft portions 36 of the secondary transfer roll 35 have come into contact with the guide slopes 53, the shaft portions 36 move while touching the guide slopes 53 slanted downward with respect to the direction of movement of the rear cover 14, so that the shaft portions 36 suffer force to be pressed downward. Accordingly, the secondary transfer roll 35 moves together with the roll retaining frame 60 in the direction indicated by the arrow B2 (against the spring force F1 of the pressure springs 85A and 85B). When the roll retaining frame 60 moves in the direction indicated by the arrow B2, the hook portions 95A and 95B in the contact surface portion 67 come into contact with the bottom plate portion 74 of the operation button 70 so that the hook portions 95A and 95B are connected to the operation button 70. In this manner, the operation button 70 moves together with the roll retaining frame 60 in the direction indicated by the arrow B2.

When the shaft portions 36 of the secondary transfer roll 35 then reach end point portions of the guide slopes 53 (which also serve as upper end portions 50*d* of the positioning grooves 50), the secondary transfer roll 35 suffers the spring force F1 of the pressure springs 85A and 85B through the roll retaining frame 60 so as to be pressed in the direction indicated by the arrow B1. Accordingly, the shaft portions 36 move in the direction C2 to go into the positioning grooves 50 so that the shaft portions 36 are fitted into the positioning grooves 50.

On this occasion, as shown in FIG. 16, the shaft portions 36 of the secondary transfer roll 35 move by a distance L (a displacement distance along the direction of the arrow B2) from a point P1 where the shaft portions 36 of the secondary transfer roll 35 come into contact with the guide slopes 53 to the upper end portions 50*d* of the positioning grooves 50. Therefore, the roll retaining frame 60 and the operation button 70 also move by a distance substantially equal to the distance L in the direction indicated by the arrow B2, correspondingly to the distance L of the shaft portions 36.

In this manner, the top surface portion 72*a* of the operation portion 72 in the operation button 70 is prevented from protruding from the upper end portion 14*a* of the rear cover 14. In addition, the operation button 70 moves to a position where the bumping portions 76 do not bump the to-be-bumped portions 18 of the top cover 17 of the apparatus body 10 but can go to locations separate slightly downward from the lower surfaces of the to-be-bumped portions 18. When the shaft portions 36 of the secondary transfer roll 35 then enter the positioning grooves 50 and move in the direction C2 to be fitted into the grooves 50, the operation button 70 is pressed by the retaining frame 60 to move in the direction indicated by the arrow B1 so that the bumping portions 76 bump the to-be-bumped portions 18 and stay still, as shown in FIG. 4. In this manner, when the rear cover 14 is closed, the close operation can be performed smoothly without operating the operation button 70.

In the operation button 70, the top surface portion 72*a* of the operation portion 72 is present inside the button exposing notch portion 19 of the top cover 17 and exposed to the outside. On this occasion, the top surface portion 72*a* is present as a flat surface which is stepless and continuous to the portions 17*a* of the top cover 17 in the periphery of the button exposing notch portion 19 (FIG. 3). As a result, the operation button 70 is aligned with the top surface portion 17 etc. well so that the external appearance of the periphery including the operation button 70 is kept good.

As described above, the rear cover 14 is closed and fixed as shown in FIGS. 3 and 4.

In this image forming apparatus 1, when the rear cover 14 is to be closed or has been closed, the position of the secondary transfer roll 35 may be displaced and moved so as to be shifted mainly in the direction C1/C2 of coming/going of the shaft portions 36 from/into the positioning grooves 50 in accordance with the respective image forming apparatuses or in the same image forming apparatus. When the state of the unit support frame 55 is changed for correcting meandering or one-sided running of the intermediate transfer belt 31 at the time of operation of the image forming apparatus 1, the positions of the positioning grooves 50 (bottom surface portions 50*c*) per se formed in the support frame 55 may be therefore displaced and moved delicately in the direction C1/C2 of coming/going of the shaft portions 36 from/into the positioning grooves 50. Movement at the time of the aforementioned displacement may be often laterally asymmetrical. The possibility of occurrence of this change becomes high when mechanical strength of the rear cover 14 is lowered because the rear cover 14 per se is thin or there is a limit to reinforcement of the rear cover 14.

The displacement of the secondary transfer roll 35 is displacement (movement) in accordance with the original correct installation position. As a result, the secondary transfer roll 35 is normally disposed in (aligned with or adjusted to) the secondary transfer position so that the secondary transfer roll 35 can perform excellent secondary transfer. In addition, when the positioning grooves 50 per se are displaced, the roll retaining frame 60 is pressed by the spring force of the pressure springs 85A and 85B so that the shaft portions 36 of the secondary transfer roll 35 are displaced following the positions of the positioning grooves 50. Thus, the second transfer roll 35 is disposed in the correct secondary transfer position so that the secondary transfer roll 35 can perform excellent secondary transfer.

On the other hand, when the secondary transfer roll 35 is displaced, the position (state) of the roll retaining frame 60 retaining the secondary transfer roll 35 also changes in the direction indicated by the arrow B1 or B2. In addition, since the roll retaining frame 60 is in contact with the lower portion (the bottom plate portion 74) of the operation button 70 in the contact surface portion 67, there is a possibility that displacement of the roll retaining frame 60 is transmitted even to the operation button 70.

When the displacement of the roll retaining frame 60 is transmitted to the operation button 70 so that the position (state) of the operation button 70 changes in the direction indicated by the arrow B1 or B2, the operation button 70 as a whole is slanted because the bumping portions 76 do not bump normally. Therefore, the top surface portion 72*a* of the operation portion 72 does not form a flat surface continuous to the top cover 17 so that a step is formed between the top surface portion 72*a* and the top cover 17. As a result, the quality of the external appearance is lowered. In addition, when the operation button 70 stays still while not touching the to-be-bumped portions 18 in a normal state, the change of the state of the operation button 70 may affect the rear cover 14 so that the alignment state of the operation button 70 with another cover (another exterior member such as a rear cover portion, the top cover 17, etc.) of the apparatus body 10 adjacent to the rear cover 14 is deteriorated.

In the image forming apparatus 1, the roll retaining frame 60 and the operation button 70 are connected to each other through the leaf spring portions 90A and 90B. Accordingly, even when the roll retaining frame 60 is displaced due to alignment of the secondary transfer roll 35, the displacement (movement) of the roll retaining frame 60 is buffered (absorbed or cancelled) by elastic deformation of the leaf spring portions 90A and 90B in the contact surface portion 67 so as to be prevented from being transmitted to the operation button 70.

As a result, in the image forming apparatus 1, when the rear cover 14 is closed, the position of the secondary transfer roll 35 can be adjusted normally and the operation button 70 can be kept in normal contact with the to-be-bumped portions 18 of the top cover 17 without being affected by the state of the position of the secondary transfer roll 35. To describe about the secondary transfer roll 35 in detail, when the rear cover 14 is closed, the secondary transfer roll 35 is retained in the positioning grooves 50 provided on the apparatus body 10 side so that the secondary transfer roll 35 can be positioned to the normal position without being affected by the rigidity of the rear cover 14.

Thus, according to the image forming apparatus 1, it is possible to ensure excellent secondary transfer and it is possible to prevent lowering of the quality of the external appearance when the rear cover 14 is closed.

Particularly, in the image forming apparatus 1, the roll retaining frame 60 is attached to be displaceable in the state in which the opposite (left and right) end portions of the roll retaining frame 60 move by different quantities in the direction of the arrow B1 or B2 and slanted as a whole with respect to the back cover 14, so that the secondary transfer roll 35 is also often displaced for alignment. However, even in this case, it is difficult to transmit displacement of the roll retaining frame 60 generated in accordance with displacement of the secondary transfer roll 35, to the operation button 70 because of presence of the leaf spring portions 90A and 90B.

In the image forming apparatus 1, when the rear cover 14 is closed, the roll retaining frame 60 is displaced in accordance with displacement of the secondary transfer roll 35 so that the leaf spring portions 90A and 90B are elastically deformed. Accordingly, as shown in FIG. 4, each of the leaf spring portions 90A and 90B generates elastic restoration force (spring force) BF in accordance with its own deformation quantity so that the spring force BF affects the operation button 70 coming into contact with (the protrusive portion 93 of) the spring plate portion 90A (90B). At the same time, reaction force HF occurs in the roll retaining frame 60 in which the spring plate portions 90A and 90B are provided. In this manner, when the leaf spring portions 90A and 90B are elastically deformed, the roll retaining frame 60 is moved by the reaction force HF so as to be pushed back in the direction indicated by the arrow B2. As a result, there is an intrinsic possibility that the position of the secondary transfer roll 35 is also changed (to thereby cause lowering of the position accuracy).

In this respect, setting is made in Embodiment 1 to hold the relation that the reaction force HF occurring due to elastic deformation of the leaf spring portions 90A and 90B is weaker than the spring force F1 of the pressure springs 85A and 85B (HF<F1). Accordingly, in the image forming apparatus 1, when the rear cover 14 is closed, there is no fear that the roll retaining frame 60 is moved to be pushed back in the direction of the arrow B2 due to the reaction force BF of the leaf spring portions 90A and 90B. As a result, the position accuracy of the secondary transfer roll 35 can be kept.

Other Embodiments

Although Embodiment 1 has been described in the case where the leaf spring portions are provided as elastic buffering members in the contact surface portion 67 of the roll retaining frame 60, the leaf spring portions may be provided in the lower portion (e.g. the bottom plate portion 74) of the operation button 70 instead of being provided in the contact surface portion 67.

Each elastic buffering member is not limited particularly as long as the elastic buffering member has its function. For example, the elastic buffering member may be formed by installation of a coiled spring, a leaf spring, or the like. When the elastic buffering member is elastically deformed in this case, configuration is preferably made so that there can be obtained the state in which the roll retaining frame 60 and the operation button 70 come into contact with each other in their elastically undeformable contact portions.

In addition, although description has been given to the case where the guide slopes 53 are provided in the outer side portions of the positioning grooves 50 near the rear cover 14 side, configuration may be made so that the guide slopes 53 can be dispensed with. When the rear cover 14 is closed in this case, the operator has to perform an operation to push down the operation button 70 in the direction of the arrow B2. Also in this case, it is preferable that the hook portions 95A and 95B are provided.

Although description has been given to the case where the secondary transfer roll 35 is used as a rotary body retained on the rear cover, any other rotary body may be used alternatively. For example, a primary transfer roll, a sheet conveying roll, or the like may be used as the other rotary roll. The open/shut cover for retaining the rotary body is not limited to the rear cover 14 positioned in the rear of the apparatus body 10. An open/shut cover disposed in any other portion of the apparatus body 10 may be used alternatively.

Although a color image forming apparatus for forming a color image by use of image forming devices 20 is preferably used as the image forming apparatus the invention aims at, a monochrome image forming apparatus may be used alternatively. The image forming apparatus may use any other method than electrophotography, for the image forming method. For example, an inkjet method or a thermal transfer method may be used instead.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body that includes an open portion which opens an inside of the apparatus body to an outside, and an open/shut cover that swings to open/close the open portion;

positioning grooves that are provided inside the apparatus body;

a rotary body that includes shaft portions that are fitted into the positioning grooves when the open/shut cover is swung to a position to close the open portion;

a rotary body retaining member that is attached to an inner side of the open/shut cover so as to be movable along a direction to bring the shaft portions of the rotary body out of the positioning grooves, and that retains the rotary body so that the rotary body can rotate therein;

pressure members that press the rotary body retaining member along a direction to bring the shaft portions of the rotary body into the positioning grooves; and an operation member that is attached to the inner side of the open/shut cover so as to be movable along the direction to bring the shaft portions of the rotary body out of the positioning grooves, wherein when the open/shut cover is swung to a position to open the open portion, the operation member comes into contact with the rotary body retaining member so as to press the rotary body retaining member in the direction to bring the shaft portions of the rotary body out of the positioning grooves, and when the open/shut cover is swung to a position to close the open portion, the operation member is contacted by the rotary body retaining member pressed by the pressure members, thereby bringing the operation member into contact with part of the apparatus body and keeping the operation member still, and wherein the rotary body retaining member and the operation member touch each other through elastic buffering members.

2. The image forming apparatus according to claim 1, wherein each of the elastic buffering members is set to hold a relation that a reaction force occurring due to elastic deformation of the elastic buffering member is weaker than a pressing force of a corresponding one of the pressure members.

3. The image forming apparatus according to claim 1, wherein the elastic buffering members are disposed in a plurality of places in a width direction along a shaft direction of the rotary body of the rotary body retaining member or the rear cover.

4. The image forming apparatus according to claim 1, wherein each of the elastic buffering members is formed as a cantilever-shaped plate portion in part of the rotary body retaining member or the open/shut cover, the cantilever-shaped plate portion including an end portion as a free end and a contact protrusive portion provide in the end portion.

5. The image forming apparatus according to claim 1, wherein the rotary body retaining member is attached to be displaceable in such a manner that opposite end portions in the width direction along the shaft direction of the rotary body move by different quantities in the direction to bring the shaft portions of the rotary body out of the positioning grooves so that the rotary body retaining member as a whole is slanted.

6. The image forming apparatus according to claim 1, wherein:

guide slopes are provided in outer portions of the positioning grooves near the open/shut cover, and when the open/shut cover is swung to the close position, the shaft portions of the rotary body touch the guide slopes to move the rotary body retaining member in the direction to bring the shaft portions of the rotary body into the positioning grooves and then are guided by the guide slopes to be fitted into the positioning grooves; and contact connection portions are provided in the rotary body retaining member, and when the rotary body retaining member moves in the direction to bring the shaft portions of the rotary body into the positioning grooves by guidance of the guide slopes, the contact connection portions come into contact with parts of the operation member so as to be connected to the operation member.

7. The image forming apparatus according to claim 1, wherein:

a notch portion is provided in a top surface portion of the apparatus body so that the operation member is received in the notch portion when the open/shut cover swings to the close position; and the operation member has a top surface portion which is exposed from the notch portion in the top surface portion of the apparatus body when the operation member comes into contact with the part of the apparatus body and is kept still, and which is formed into a shape stepless and continuous to the top surface portion of the apparatus body existing in a periphery of the exposed top surface portion.

8. The image forming apparatus according to claim 1, wherein the rotary body is made of a secondary transfer roll which rotates while coming in contact with an intermediate transferer conveying an unfixed image formed from at least one developing agent.

* * * * *